US006530651B2

(12) United States Patent
Kubota et al.

(10) Patent No.: US 6,530,651 B2
(45) Date of Patent: Mar. 11, 2003

(54) LIQUID EJECTING HEAD, LIQUID EJECTING METHOD, AND METHOD FOR MANUFACTURING LIQUID EJECTING HEAD

(75) Inventors: Masahiko Kubota, Tokyo (JP); Masanori Takenouchi, Kanagawa (JP); Sadayuki Sugama, Ibaraki (JP); Masao Mori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/082,324

(22) Filed: Feb. 26, 2002

(65) Prior Publication Data

US 2002/0126183 A1 Sep. 12, 2002

(30) Foreign Application Priority Data

Mar. 2, 2001 (JP) ..... 2001-058329

(51) Int. Cl.[7] ..... B41J 2/05
(52) U.S. Cl. ..... 347/65
(58) Field of Search ..... 347/56, 61, 63, 347/65, 67, 94

(56) References Cited

U.S. PATENT DOCUMENTS

| | | | | |
|---|---|---|---|---|
| 5,278,585 A | | 1/1994 | Karz et al. | 347/65 |
| 5,838,351 A | * | 11/1998 | Weber | 347/67 |
| 6,168,264 B1 | | 1/2001 | Yoshihira et al. | 347/65 |
| 6,270,200 B1 | | 8/2001 | Ishinaga et al. | 347/65 |
| 6,305,789 B1 | | 10/2001 | Nakata et al. | 347/61 |
| 2002/0021335 A1 | | 2/2002 | Sugama et al. | 347/65 |

FOREIGN PATENT DOCUMENTS

| | | | | |
|---|---|---|---|---|
| EP | 0436047 | | 7/1991 | B41J/2/055 |
| JP | 02113950 | * | 4/1990 | B41J/2/175 |
| JP | 6-31918 | | 2/1994 | B41J/2/05 |
| JP | 9-48127 | | 2/1997 | B41J/2/05 |
| JP | 9-131891 | | 5/1997 | B41J/2/175 |
| JP | 9-323420 | | 12/1997 | B41J/2/05 |
| JP | 10-24588 | | 1/1998 | B41J/2/05 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid ejecting head is provided comprising a member provided with a plurality of ejecting outlets; a substrate having a plurality of bubble generating means; a plurality of liquid flow paths; a common liquid supply chamber; and a plurality of movable members disposed in the longitudinal direction of the liquid supply inlet. According to this novel liquid ejecting head having the structure described above, improvements of both ejecting power and ejecting frequency can be achieved, and a conventional problem in which liquid flow paths are adversely affected to each other can also be solved. A method for ejecting liquid using the liquid ejecting head described above and a manufacturing method therefor are also disclosed.

20 Claims, 26 Drawing Sheets

LIQUID EJECTING HEAD, LIQUID EJECTING METHOD, AND METHOD FOR MANUFACTURING LIQUID EJECTING HEAD

BACKGROUND OF THE INVENTION

1. Field of the Invention

The present invention relates to a liquid ejecting head for ejecting liquid using a bubble formed by applying thermal energy to the liquid, a method for ejecting liquid using the same, and a method for manufacturing the liquid ejecting head.

In addition, the present invention can be applied to various apparatuses, such as a printer, a copying machine, facsimile machines having a communication system, and a word processors having a printing portion, which perform recording on recording media, such as paper, thread, fiber, textile, leather, metal, plastic, glass, wood, and ceramic, and can also be applied to industrial recording equipment functionally combined with various processing apparatuses.

In the present invention, "recording" not only means that meaningful images such, as letters and figures, are input on a recording medium but it means that meaningless images such as patterns are input thereon.

2. Description of the Related Art

In liquid ejecting heads which have been used in practice, an ejection element (for example, an electro-thermal transducer used for forming a bubble or a piezoelectric element which is displaced or deformed) driven for ejecting a liquid droplet is disposed at a position corresponding to an ejecting outlet. When this ejection element is driven, a liquid droplet to be ejected is formed by the generation of a pressure wave or a liquid flow which moves the liquid toward the ejecting outlet, and in addition, a pressure wave or a liquid flow toward a liquid chamber is also generated for refilling the liquid in the ejection element. This liquid chamber may be used as a common liquid chamber when a plurality of liquid flow paths, each provided with an ejection element and an ejecting outlet, is arranged to communicate with this chamber.

A pressure wave or a liquid flow toward this liquid chamber or the common liquid chamber is collectively called as "a backwave" and may interfere with the refilling or may impose a meniscus vibration component on adjacent ejecting outlets in some cases. A number of inventions focusing on this "backwave" have been proposed, and among those mentioned above, constituent elements, such as a member (membrane, valve, or the like) for blocking or absorbing a backwave, provided in a liquid flow path having an ejection element and an ejecting outlet have been frequently proposed. For example, according to the invention disclosed in Japanese Unexamined Patent Laid-Open No. 6-31918 (specifically, see FIG. 3), a flat and triangular-shaped member is disposed so that the corner of the triangle opposes a heater used for generating a bubble. In this invention, this flat member temporarily and slightly reduces the backwave. However, since the relationship between the triangular shape and the growth of a bubble has not been mentioned and has not been considered, the invention described above has the following problems.

That is, according to the invention disclosed in the publication described above, since the heater is disposed at the bottom of a recess portion and is not allowed to linearly communicate with the ejecting outlet, the form of liquid droplet cannot be stable. In addition, since bubbles are allowed to grow at the periphery of the corner of the triangle shape, the bubbles grow from one side of the flat and triangle-shaped member to the entire opposite side thereof, and as a result, the general growth of bubbles is complete in the liquid as if the flat member has not been disposed. Accordingly, the bubbles thus grown have not been affected by the presence of the flat member at all. In contrast, since the entire flat member is surrounded by bubbles, when the bubbles contract, the refilling to the heater disposed in the recess generates a turbulent flow, thereby forming minute bubbles in the recess. As a result, the primary object to eject liquid by the growth of a bubble cannot be achieved satisfactorily.

In addition, according to EP Laid-Open No. 436047A1, an invention is proposed in which a first valve, which is provided between an area in the vicinity of an ejecting outlet portion and a bubble generating region so that these portions are blocked from each other, and a second valve, which is provided between the bubble generating region and an ink supplying portion so that these portions are completely blocked from each other, are alternately opened and closed (specifically, see FIGS. 4 to 9 of EP Laid-Open No. 436047A1). However, according to this invention, since these three portions are divided into two parts by the valve operation described above, ink following a liquid droplet when it is ejected will make a long trail, and satellite dots will be increased compared to the general ejecting method in which bubble growth, contraction, and defoaming are sequentially performed (the reason for this is considered that the effect of meniscus recession caused by defoaming may not be used). In addition, during refilling, liquid is supplied to the bubble generating region while bubbles are being defoamed; however, since liquid is not supplied to the vicinity of the ejecting outlet until subsequent bubble generation occurs, liquid droplets ejected vary considerably, and in addition, response frequency for ejection is extremely small. As a result, the proposal described above cannot be used practically.

A number of inventions each using a movable member (for example, a flat member having a free end closer to an ejecting outlet side than the fulcrum), which can effectively improve liquid ejecting properties and are completely different from the conventional techniques described above, has been proposed by the inventors of the present invention. Among the inventions described above, Japanese Unexamined Patent Laid-Open No. 9-48127 discloses an invention in which the upper limit of displacement of a movable member is controlled to make the movable member move strictly as it is designed. In addition, Japanese Unexamined Patent Laid-Open No. 9-323420 discloses an invention in which the position of a common liquid chamber at an upstream side with respect to the position of the movable member is shifted to that of the free end side thereof, that is, to the downstream side, by using the advantages of the movable member in order to improve the refilling ability.

In addition, in Japanese Unexamined Patent Laid-Open No. 10-24588, an invention focusing on bubble growth caused by pressure wave propagation (acoustic wave) as a factor of liquid ejection is disclosed in which a part of the bubble generating area is free from the movable member described above. In addition, for example, in Japanese Unexamined Patent Laid-Open No. 2000-621845, a technique is disclosed in which, by analyzing the process from the bubble generation to defoaming in detail in view of the formation of liquid droplets to be ejected, specific printing quality obtained by an inkjet device is decreased, satellite dots which contaminate a device itself or a recording medium are decreased, the refilling can be performed at a high speed, the vibration of meniscus can be quickly converged, and the image quality can also be obtained stably during continuous ejection process.

In addition, a bimetal method in which ideal switching of the movable member or the valve unit described above is performed by independent driving without being dependent on the behavior of an ejection element has been disclosed in Japanese Unexamined Patent Laid-Open No. 9-131891. In this publication, a liquid flow path forms a single head, and a valve completely blocks a connection portion between the liquid flow path and a liquid chamber as shown in FIG. 8. In another example of this publication, a plurality of bimetals which are driven by displacement in a single liquid flow path has been disclosed. According to this publication, wires and electrical power are necessary for driving switching bimetals, and hence, this invention is difficult to apply a liquid ejecting head containing a number of liquid flow paths.

SUMMARY OF THE INVENTION

As described above, the properties of each liquid flow path have been improved by the conventional structure; however, influences between a plurality of liquid flow paths have not been seriously considered.

In consideration of these technical problems described above, the advantages and disadvantages of conventional movable members such as valves were reevaluated, and novel and effective functions/actions were pursed by forming new movable members in order to realize a liquid ejecting head which can reduce back wave generation, has a hybrid structure composed of a plurality of liquid flow paths, and in addition, can perform refilling at a high speed even while continuous ejection is being performed. Through this intensive research by the inventors of the present invention, an invention for improving in mechanical strength of a fulcrum portion of a movable member, an invention focusing on the arrangement of movable members, an invention for reducing crosstalks between adjacent liquid flow paths in a common liquid supply chamber region by using a plurality of movable members, and the like were made.

To these ends, a liquid ejecting head according to one aspect of the present invention is provided which comprises a member provided with a plurality of ejecting outlets for ejecting liquid; s substrate having a plurality of bubble generating means which generates thermal energy for generating and growing a bubble used for ejecting the liquid, the bubble generating means opposing the associated ejecting outlet; a plurality of liquid flow paths each of which communicates with the associated ejecting outlet and has a bubble generating region for generating the bubble in the liquid by the thermal energy; a liquid supply inlet which is a long through-hole formed in the substrate; a common liquid supply chamber which communicates with the plurality of said liquid flow paths via the liquid supply inlet and which supplies liquid to the plurality of said liquid flow paths via the liquid supply inlet; and a plurality of movable members disposed in the longitudinal direction of the liquid supply inlet so as to cover the liquid supply inlet, each of the movable members having a free end in the associated liquid flow path and being supported above the liquid supply inlet with a minute spacing therebetween.

In a method for ejecting liquid by using a liquid ejecting head in accordance with another aspect of the present invention, the liquid ejecting head comprises a member provided with a plurality of ejecting outlets for ejecting liquid; a substrate having a plurality of bubble generating means which generates thermal energy for generating and growing a bubble used for ejecting the liquid, the bubble generating means opposing the associated ejecting outlet; a plurality of liquid flow paths each of which communicates with the associated ejecting outlet and has a bubble generating region for generating the bubble in the liquid by the thermal energy; a liquid supply inlet which is a long through-hole formed in the substrate; a common liquid supply chamber which communicates with the plurality of said liquid flow paths via the liquid supply inlet and which supplies liquid to the plurality of said liquid flow paths via the liquid supply inlet; and a plurality of movable members each disposed in the associated liquid flow path so as to cover the liquid supply inlet with a minute spacing therebetween, the movable member having a free end and a supporting portion, the free end being provided so as not to overlap the bubble generating region. The method for ejecting liquid mentioned above comprises a step of substantially blocking the liquid supply inlet without contacting the bubble.

In addition, in a method for manufacturing a liquid ejecting head in accordance with another aspect of the present invention, the liquid ejecting head comprises a plurality of ejecting outlets for ejecting liquid; a plurality of liquid flow paths each of which always communicates with the associated ejecting outlet at one end of the liquid flow path and which has a bubble generating region for generating a bubble in the liquid; bubble generating means which generates thermal energy for generating and growing the bubble; a substrate having the bubble generating means; a liquid supply inlet which communicates with the plurality of said liquid flow paths and which is a long through-hole formed in the substrate; and a plurality of movable members each having a free end and being supported above the liquid supply inlet at the liquid flow path side with a minute spacing therebetween. The method for manufacturing the liquid ejecting head described above comprises a step of forming a membrane layer on the substrate in an area at which the liquid supply inlet is formed; a step of providing the bubble generating means and the movable members on the substrate; a step of forming a liquid flow path pattern for forming the plurality of said liquid flow paths on the substrate provided with the bubble generating means and the movable members; a step of applying a material for forming walls of the liquid flow paths so as to cover the liquid flow path pattern; a step of performing anisotropic etching of the substrate from the rear side thereof which is opposite to the side on which the movable members are formed; a step of removing the membrane layer provided in the area at which the liquid supply inlet is formed by dry etching using the liquid flow path pattern as an etching stopper film for forming a through-hole used as the liquid supply inlet; and a step of removing the liquid flow path pattern.

Since the liquid ejecting head in accordance with the present invention has the structure described above, pressure waves generated by bubble growth in bubble generating regions are not propagated to a liquid supply inlet side and other liquid flow paths, and most of the pressure waves move toward ejecting outlet sides, whereby ejecting power can be significantly increased.

Further objects, features and advantages of the present invention will become apparent from the following description of the preferred embodiments (with reference to the attached drawings).

DESCRIPTION OF THE PREFERRED EMBODIMENTS

First Embodiment

Figure 1:
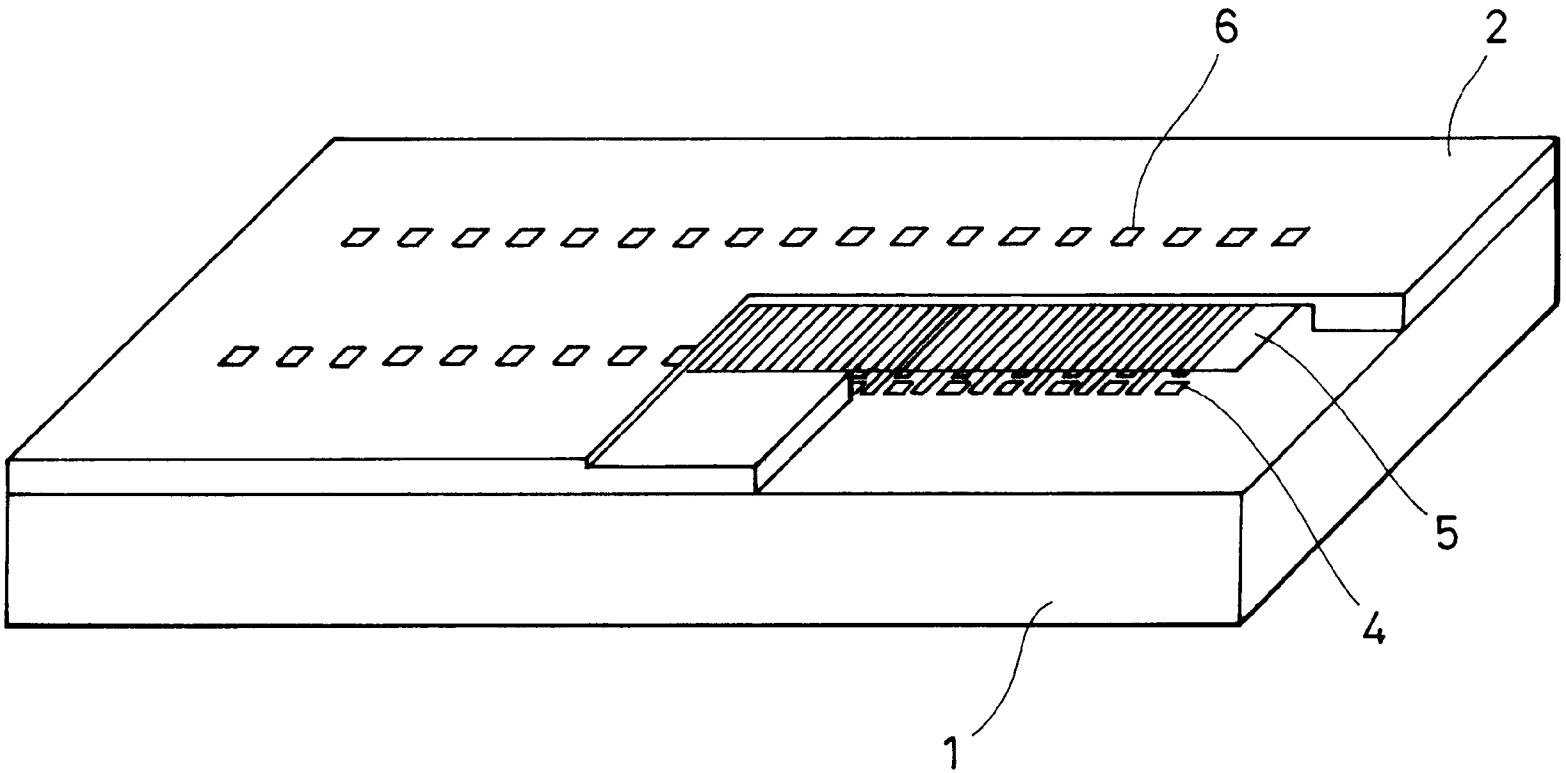
FIG. 1 is a schematic view showing a liquid ejecting head according to a first embodiment of the present invention.
Figure 2:
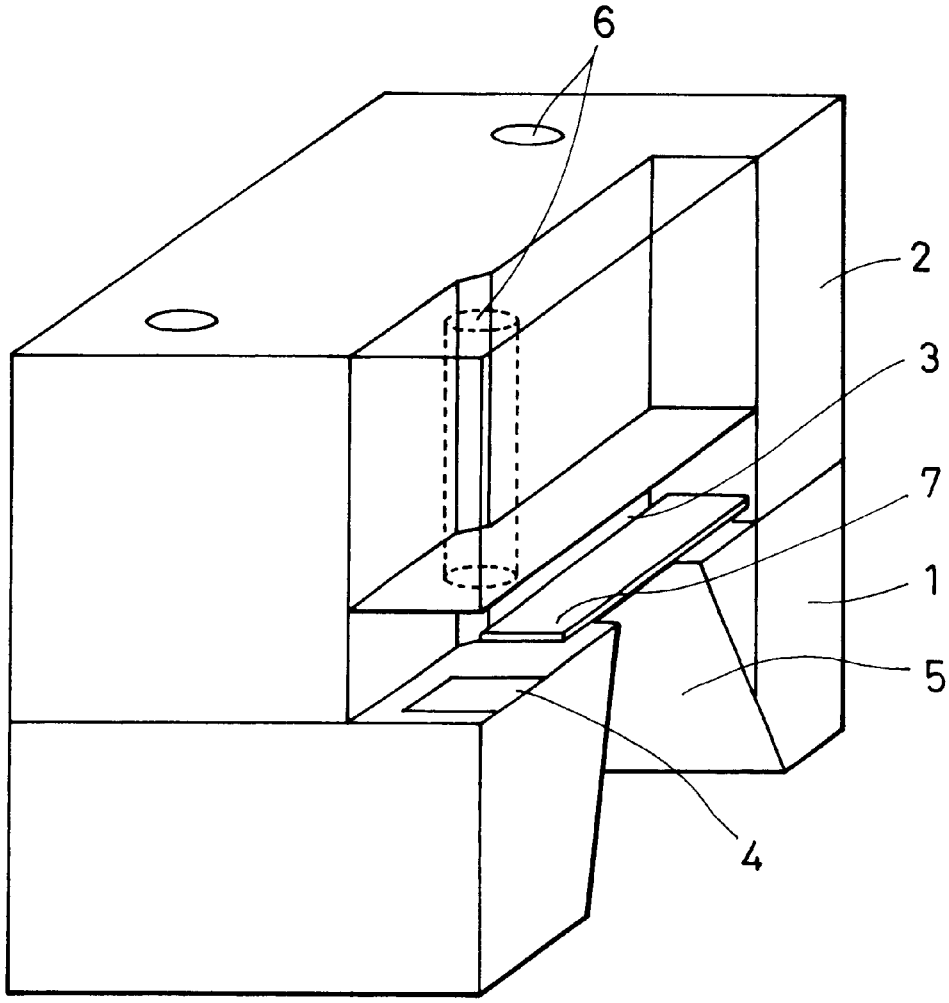
FIG. 2 is a schematic cross-sectional view showing the structure of a major portion of the liquid ejecting head according to the first embodiment of the present invention.
Figure 3:
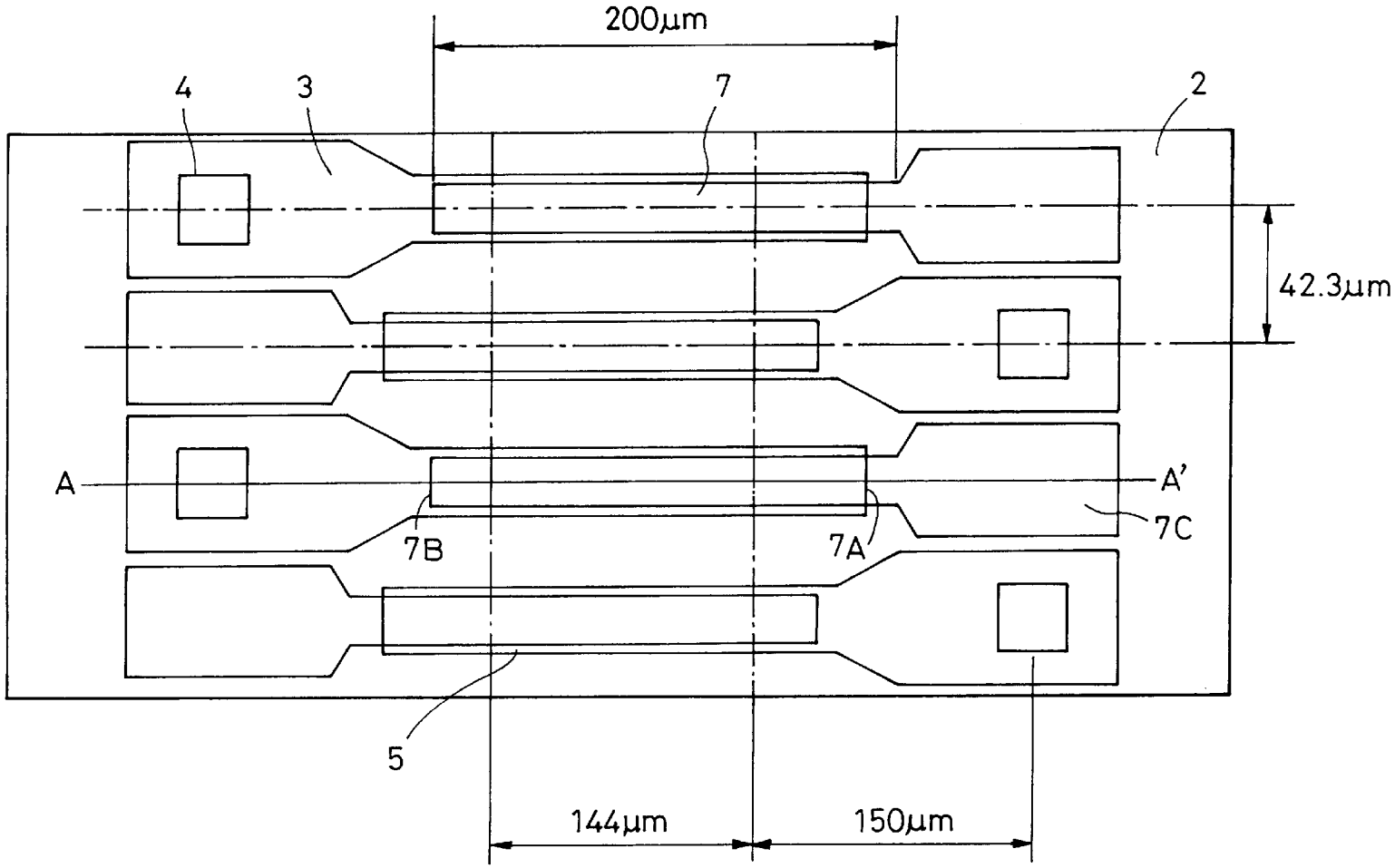
FIG. 3 is a cross-sectional view showing the liquid ejecting head in the direction of liquid ejection according to the first embodiment of the present invention.
Figure 4:
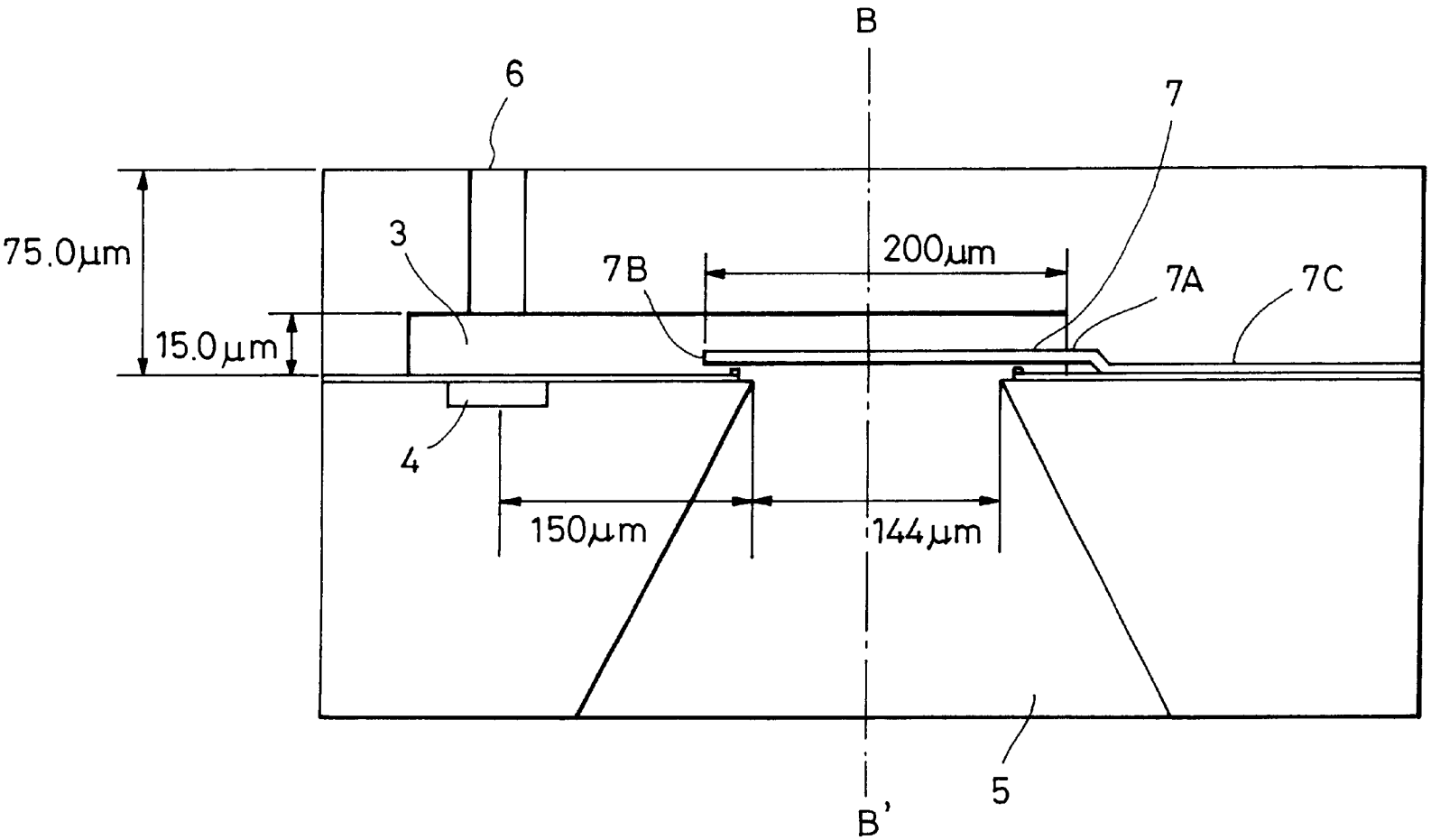
FIG. 4 is a cross-sectional view taken along the line A–A' in FIG. 3.
Figure 5:
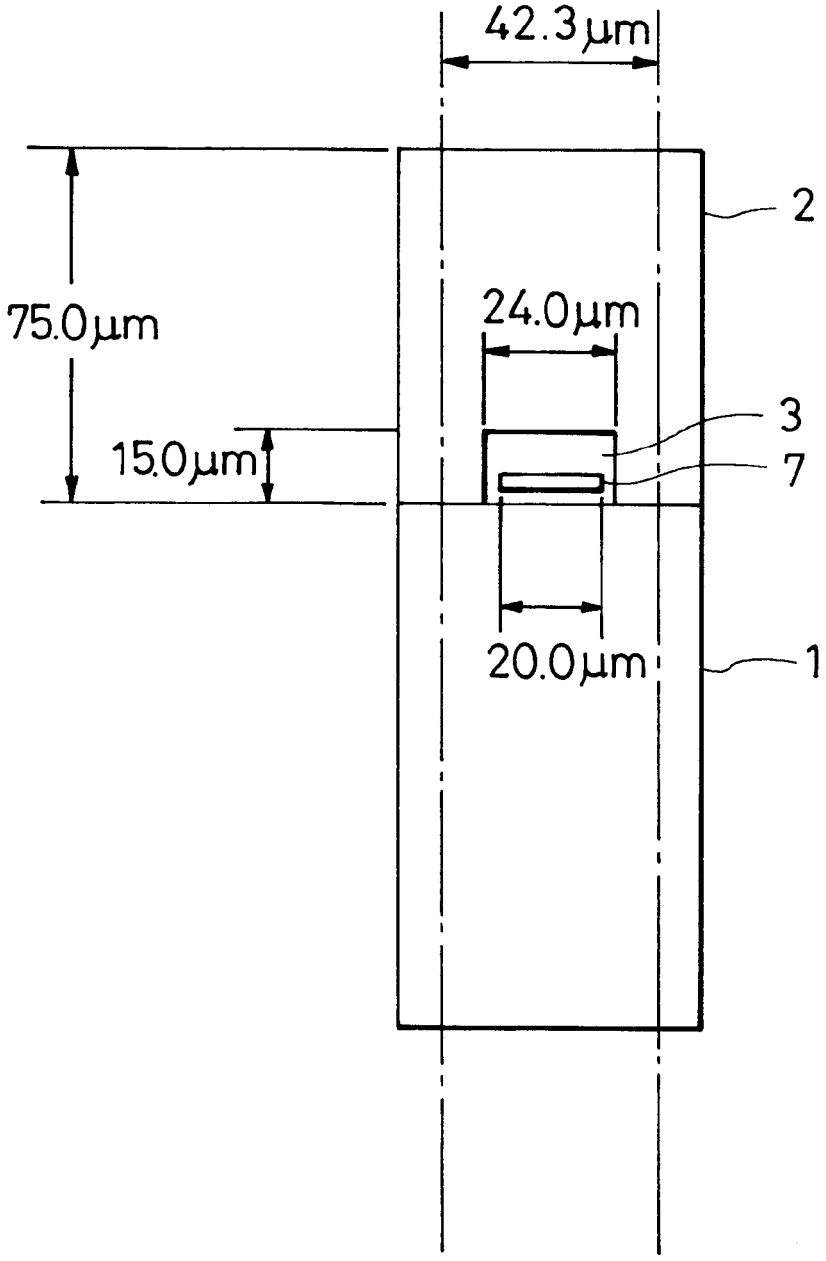
FIG. 5 is a cross-sectional view taken along the line B–B' in FIG. 4.

FIG. 1 is a schematic view showing a liquid ejecting head according to a first embodiment of the present invention. FIG. 2 is a schematic cross-sectional view showing the structure of a major portion of the liquid ejecting head shown in FIG. 1. FIG. 3 is a cross-sectional view showing the liquid ejecting head shown in FIGS. 1 and 2 in the direction of liquid ejection according to the first embodiment of the present invention. FIG. 4 is a cross-sectional view taken along the line A–A' in FIG. 3, and FIG. 5 is a cross-sectional view taken along the line B–B' in FIG. 4.

In the liquid ejecting head shown in FIGS. 1 to 5, when an ejecting outlet forming member 2 provided with ejecting outlets is laminated on and bonded to a silicon substrate 1, ejecting outlets 6 are provided, and in addition, liquid flow paths 3 are formed by the substrate 1 and the ejecting outlet forming member 2. A plurality of the liquid flow paths 3 is formed in one liquid ejecting head.

In addition, heat generating elements 4 such as an electrothermal transducer, each used as bubble generating means for generating a bubble in liquid which is refilled in the liquid flow path 3, are disposed on the substrate 1 so as to correspond to associated liquid flow paths 3. In the vicinity of the interface between the heat generating element 4 and liquid to be ejected, a bubble generating region 8 exists which generates a bubble in the liquid when the heat generating element 4 rapidly generates heat.

In the substrate 1, a liquid supply inlet 5 in the form of a long through-hole is formed which communicates with the plurality of liquid flow paths 3 at one side thereof and communicate with a common liquid supply chamber (not shown) at the other end thereof. That is, one liquid supply inlet 5 communicate with a plurality of the liquid flow paths 3, and each liquid flow path 3 receives liquid at an amount corresponding to that ejected from the ejecting outlet 6, which communicates with the associated liquid flow path 3, from the common liquid supply chamber via the liquid supply inlet 5.

In the liquid flow paths 3, movable members 7 are provided approximately parallel with each other so as to cover the liquid supply inlet 5 with a small spacing a therebetween (for example, 5 $\mu$m or less), and one end portion 7B of the movable member 7, which is at the ejecting outlet 6 side, is a free end located at the heat generating element 4 side of the substrate 1. In addition, the other ends of the movable members 7 are fixed independently from each other by the ejecting outlet forming member 2.

Reference numeral 7A in FIGS. 3 and 4 indicates the bottom of each movable member 7 which is fixed with the ejecting outlet forming member 2, and this bottom serves as the fulcrum when the movable member 7 is displaced. When the width of the end of the movable member 7 which is fixed with the ejecting outlet forming member 2 (bottom supporting portion 7C) is formed larger than that of the movable member 7 in the liquid flow path 3, superior adhesion can be obtained and the movable member 7 can be fixed stably. In addition, a plurality of the movable member 7 corresponding to the plurality of the liquid flow paths 3 is provided for one liquid supply inlet 5. According to this structure, the effect of suppressing vibration of liquid in the liquid supply inlet 5 or propagation of a pressure wave in each liquid flow path 3 can be obtained, and even when the bubble generating means is not driven, crosstalks can be reduced, whereby stable ejection can be performed.

Among the liquid flow paths 3 described above, liquid flow paths 3 corresponding to movable members located at both ends of the plurality of said movable members may be dummy liquid flow paths (the dummy liquid flow path is a liquid flow path which does not eject liquid). In the case described above, the structure in which each liquid flow path which ejects liquid is disposed between liquid flow paths each provided with a movable member is formed. Accordingly, even when a pressure wave is propagated from the liquid flow path to the liquid supply inlet, the crosstalks can be reduced by the movable members in liquid flow paths adjacent to the liquid flow path mentioned above, and hence, stable liquid ejection can be performed. In place of the bubble generating means, these effects described above can also be obtained by pressure generating means using a piezoelectric element as means for generating energy in order to eject liquid.

In addition, between the movable member 7 and the side surfaces of the liquid flow path 3 formed by the ejecting outlet forming member 2, very small spacings are always formed at both sides of the movable member 7, and the liquid flow path 3 and liquid supply inlet 5 communicate with each other via these spacings.

Figure 6:
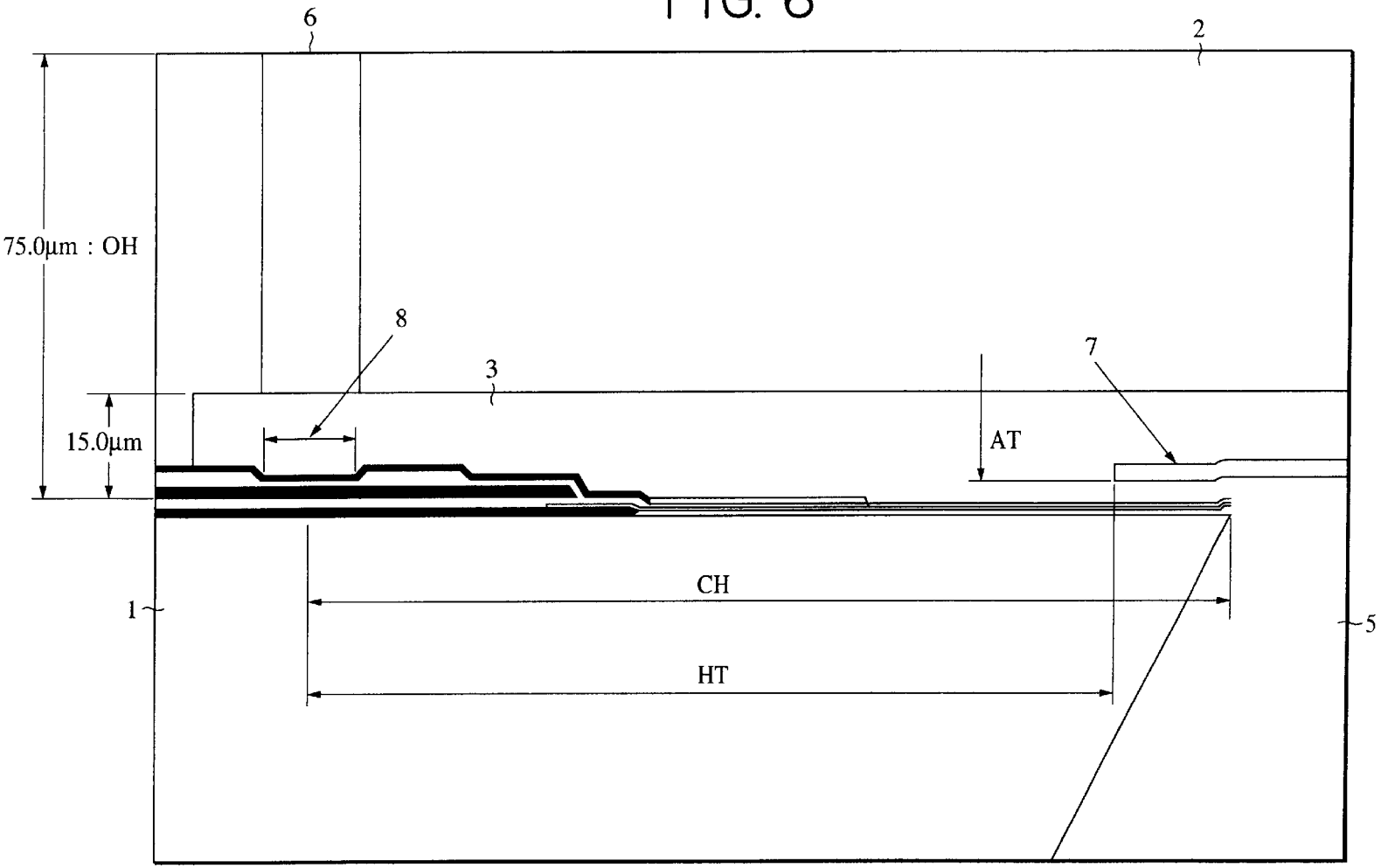
FIG. 6 is a detailed view of a part of the liquid ejecting head shown in FIG. 4.
Figure 7:
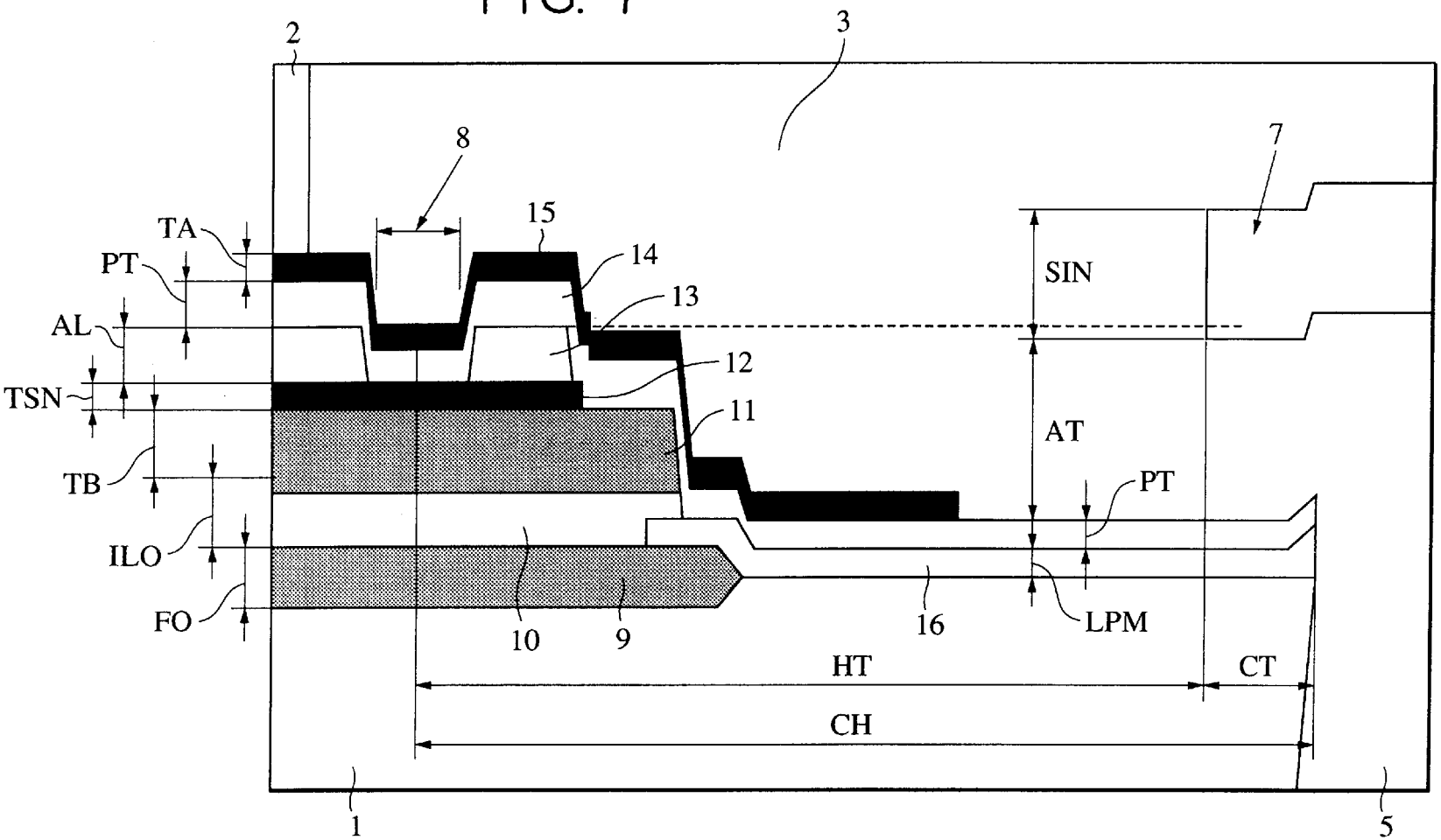
FIG. 7 is an enlarged and schematic cross-sectional view showing the major portion shown in FIG. 6.

FIGS. 6 and 7 are views for further illustrating the elements and the movable member 7 on the substrate 1 of the liquid ejecting head described with reference to FIGS. 3 to 5. In particular, FIG. 7 is an enlarged view of a major portion shown in FIG. 6.

In FIGS. 6 and 7, reference numeral 1 indicates a Si substrate, and reference numeral 9 indicates a field oxide film. In addition, reference numeral 10 indicates a heat-accumulating layer, reference numeral 11 indicates an interlayer film, which is also used as a heat-accumulating layer, composed of a $SiO_2$ film or a $Si_3N_4$ film, reference numeral 12 indicates a heating resistor layer, reference numeral 13 indicates an Al alloy wire layer composed of Al, Al—Si, Al—Cu, or the like, and reference numeral 14 indicates a protection film composed of a $SiO_2$ film or a $Si_3N_4$ film. Reference numeral 15 indicates an anticavitation film for protecting the protection film 14 from chemical and physical impacts caused by heat generation of the heating resistor layer 12. In addition, reference numeral 8 indicates a bubble generating region above the heating resistor layer 12 in an area at which the second wire layer 13 is not formed. These layers described above are formed on the Si substrate 1 using semiconductor manufacturing techniques, and a plurality of the bubble generating regions is formed on the same substrate.

As shown in FIGS. 6 and 7, the position (height) of the top surface of the bubble generating region 8 determined by laminating individual layers on the substrate is higher than that of the bottom surface of the free end 7B in the initial stage. In this stage, the top surface of the bubble generating region 8 and the bottom surface of the free end 7B of the movable member 7 may be flush with each other. In the case in which the thicknesses of an Al sacrifice layer (not shown, the thickness thereof is equivalent to the distance between the lower surface of the movable member 7 and the surface of the substrate), the field oxide film 9, the heat-accumulating layer 10, the interlayer film 11, a membrane film 16, the heating resistor layer 12, the first wiring layer, the second wire layer 13, the protection layer 14, the anticavitation film 15, and an AE sacrifice layer are represented by AT, FO, ILO, TB, LPM, TSN, AL1, AL2, PT, TA, and PO, respectively, the structure described above can be obtained when the following equation is satisfied, $$\{(FO/2)+TB+ILO+TSN+TA)\} \geqq \{AT+LPM\}.$$

When the folded wiring structure is formed, the structure described above can be obtained when the following equation is satisfied, $$\{(FO/2)+TB+ILO+TSN+Al1+TA)\} \geqq \{AT+LPM\}.$$

In addition, the position (height) of the top surface of the bubble generating region 8 is preferably lower than that of the top surface of the free end 7B of the movable member 7 in the initial stage. When the thickness of the movable member 7 is represented by SIN, the structure described above can be obtained when the following equation is satisfied, $$\{SIN+AT+LPM\} > \{(FO/2)+TB+ILO+TSN+TA)\} \geqq \{AT+LPM\}.$$

From the bubble generating region 8 to the free end 7B of the movable member 7, the structure inclining downward in a step-wise manner is formed. As described above, since the cross-sectional structure formed of the individual functional layers has a gentle slope, the movable member allows liquid to flow so as to easily block the liquid supply inlet when bubble generation starts, and in addition, when refilling is performed from the liquid supply inlet into the liquid flow path, the liquid tends to easily flow.

The distance between the free end 7B of the movable member 7 and the edge of the liquid supply inlet 5 is larger than the spacing between the bottom surface of the movable member 7 and the surface of the substrate.

The movable member 7 only covers an area of the liquid supply inlet 5 side apart from the anticavitation film so that the anticavitation film is not located below the movable member 7. According to the structure described above, liquid supply can be improved by the wettability of an insulating film, and hence, rapid liquid supply can be further improved.

In addition, when distance between the top surface (heat radiating surface) of the bubble generating means and the ejecting outlet 6 is represented by OH, the opening area of the ejecting outlet 6 is represented by So, the distance between the center of the bubble generating region 8 and the free end 7B of the movable member 7 is represented by HT, and the cross-sectional area of the liquid flow path 3 is represented by Sh, the following equation is satisfied, $$OH \times So > HT \times Sh.$$

When HT is determined so as to satisfy the above equation, ejection efficiency can be particularly improved.

In addition, in the vicinity of the free end 7B of the movable member 7 (corresponding to a step formed by the AE sacrifice layer (not shown) and the membrane film 16), a step downward from the fulcrum to free end 7B is formed. This step is formed due to the presence of the step formed by anisotropic etching of the sacrifice layer (polysilicon) and the membrane film (LP-SiN), and it is believed that the shape described above improves the blocking effect when bubble generation starts.

The distance HT from the center of the bubble generating region 8 to the free end 7B of the movable member 7 is set to a predetermined distance so that the movable member 7 does not cover a driving element formed on the substrate 1.

In this embodiment, the dimensions of the individual constituent elements are set as follows; the width of the liquid supply inlet 5 is 144 $\mu$m, the gap between the liquid flow paths 3 is 42.3 $\mu$m, the distance CH from the center of the bubble generating region 8 to the liquid supply inlet 5 is 150 nm, the distance OH from the top surface of the bubble generating region 8 to the ejecting outlet 6 is 75 $\mu$m, the height of the liquid flow path 3 is 15 $\mu$m, the width of the liquid flow path 3 is 24 $\mu$m (that is, the cross-sectional area Sh of the liquid flow path 3 is 360 $\mu m^2$), the opening area So of the ejecting outlet 6 is 500 to 600 $\mu m^2$, the distance HT from the center of the bubble generating region 8 to the free end 7B of the movable member 7 is 100 to 140 $\mu$m, the length of the movable member 7 is 200 $\mu$m, the width of the movable member 7 is 20 $\mu$m, the thickness of the movable member 7 is 3.0 $\mu$m, and the spacing between the bottom surface of the movable member 7 and the surface of the substrate is 3.0 $\mu$m.

Figure 8:
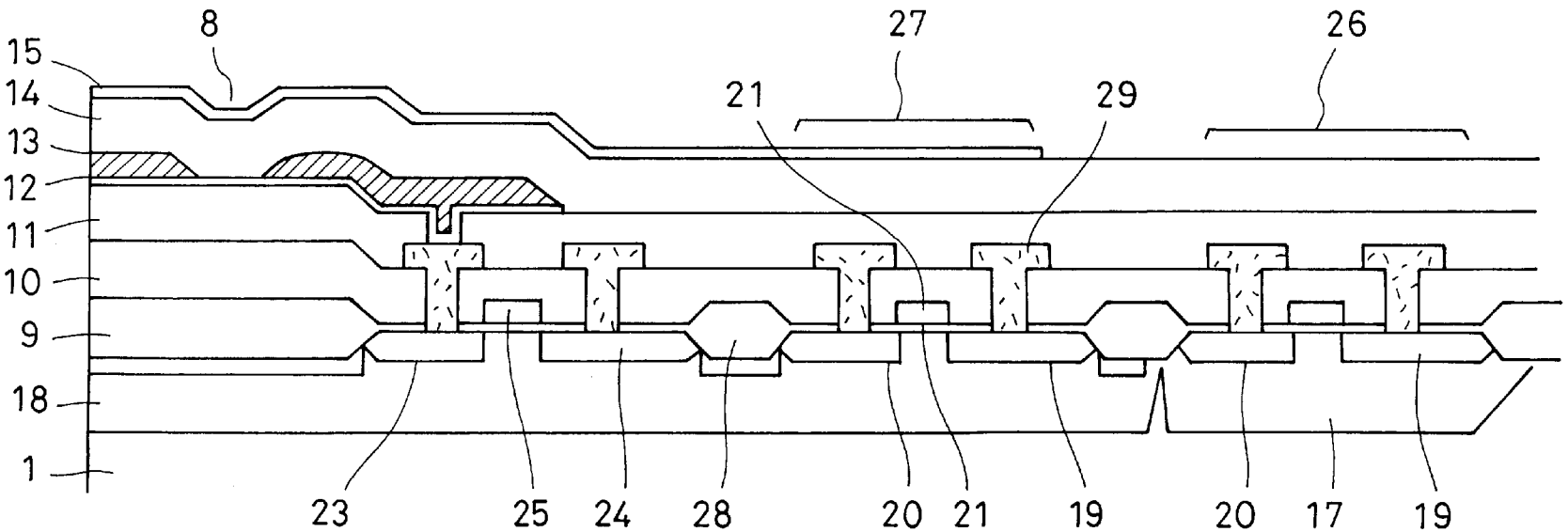
FIG. 8 is a schematic cross-sectional view showing the major elements shown in FIG. 6.

FIG. 8 is a schematic cross-sectional view showing a major part of the liquid ejecting head shown in FIG. 6.

As shown in FIG. 8, first, in accordance with a general MOS process, a p-MOS transistor 26 and an n-MOS transistor 27 are formed in an n-type well region 17 and a p-type well region, respectively, by doping using an ion implantation or a diffusion method.

Each of the p-MOS transistor 26 and the n-MOS transistor 27 is formed of a gate wire 22 formed of polysilicon 4,000 to 5,000 Å thick deposited by a CVD method above the substrate with a gate insulating film 21 some hundreds Å thick provided therebetween, an n or p-type doped source region 19 and drain region 20, and the like. These p-MOS transistor and n-MOS transistor form a C-MOS logic.

An element driving n-MOS transistor is formed of a drain region 23, a source region 24, a gate wire 25, and the like in a p-well substrate by a doping step such as ion implantation or diffusion.

When an n-MOS transistor is used as an element driver, the minimum distance between the drain and the source which form one transistor is approximately 10 $\mu$m. In this distance, i.e., 10 $\mu$m long, between the drain and the source, the contacts 417 with the source and the drain are 4 $\mu$m (2×2 $\mu$m) long; however, the half thereof is also used for an adjacent transistor, it is actually one half of 4 $\mu$m, that is, 2 $\mu$m. In addition, the distance between the first wire layer 29 and the gate wire 25 is 4 $\mu$m (2×2 $\mu$m), and the gate wire 25 is 4 $\mu$m wide, whereby the minimum distance is 10 $\mu$m.

Between the elements, since isolation oxide regions 28 having a thickness of 5,000 to 10,000 Å are formed by field oxidation, the elements are isolated from each other. The field oxidation film 9 located under the bubble generating region 8 serves as a heat-accumulating layer.

After the individual elements are formed, a heat-accumulating layer 10 composed of a PSG film, a BPSG film, or the like, having a thickness of approximately 7,000 Å is formed by a CVD method, planarization is performed by heat treatment, and wiring is then performed using Al electrodes, which form the first wire layer 29, via contact holes.

Subsequently, an interlayer film 11 composed of a $SiO_2$ film or the like having a thickness of 10,000 to 15,000 Å is formed by a plasma CVD method, and in addition, a $TaN_{0.8}$ film having a thickness of approximately 1,000 Å is formed by a DC sputtering method as the heating resistor layer 12.

Next, Al electrodes for forming the second wire layer 13 are formed which are used as wires connected to the individual heat generating elements 4.

Next, a protection layer 14 composed of a $Si_3N_4$ film having a thickness of approximately 10,000 Å is formed by plasma CVD, and an anticavitation film 15 composed of Ta or the like having a thickness of approximately 2,500 Å is deposited as the top layer, thereby forming a recording head base.

Ejecting outlets 6 for ejecting liquid and the like are then formed in the recording head base thus formed, thereby forming the liquid ejecting head.

Next, ejecting operation of the liquid ejecting head of this embodiment will be described in detail. In order to describe the ejecting operation of the liquid ejecting head having the structure described above of the present invention, FIGS. 20A to 20F show cross-sectional views of the liquid ejecting head in the direction of a liquid flow path 3, and a particular phenomenon will be described by the following six steps shown in the figures.

Figure 20A:
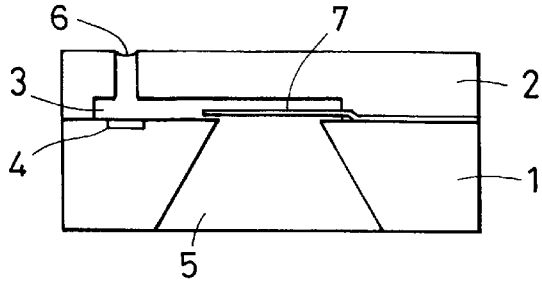
FIGS. 20A to 20F are cross-sectional views for illustrating steps of an ejecting method according to the first embodiment of the present invention.

FIG. 20A shows the state before energy such as electrical energy is applied to the heat generating element 4, that is, the state before the heat generating element 4 generates heat. In this state, there is a minute spacing (approximately 3 $\mu$m) between the movable member 7 provided between the liquid supply inlet 5 and the liquid flow path 3 and the upper level of the liquid supply inlet 5.

Figure 20B:
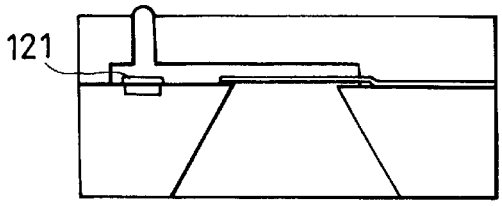

FIG. 20B shows the state in which a part of the liquid which fills the liquid flow path 3 is heated by the heat generating element 4, the film boiling phenomenon occurs on the heat generating element 4, and a bubble 121 grows isotropically. In this step, "bubble grows isotropically" means the state in which bubble growth rates at any positions on the bubble surface in the direction perpendicular thereto are approximately equivalent to each other.

In the isotropic growth process of the bubble 121 in the initial bubble generation, the liquid supply inlet 5 is substantially blocked since the movable member 7 moves toward the liquid supply inlet 5 side, and hence, the liquid flow path 3 is substantially placed in a closed state except for the ejecting outlet 6. This closed state lasts for a certain period of time in the isotropic growth process of the bubble 121. This closed state may last for a certain period of time from an application of a driving voltage to the heat generating element 4 to the end of the anisotropic growth process of the bubble 121.

In addition, in this closed state, the inertance (the degree of difficulty for static liquid to move suddenly) of the liquid in the liquid flow path 3 from the center of the heat generating element 4 to the liquid supply inlet 5 side substantially becomes infinite. In the step described above, the inertance from the heat generating element 4 to the liquid supply inlet 5 side becomes infinite with an increase in distance between the heat generating element 4 and the movable member 7.

Figure 20C:
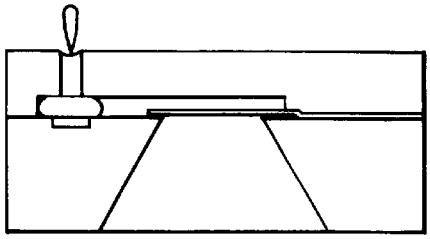

FIG. 20C shows the state in which the bubble 121 keeps growing. In this state, since the liquid flow path 3 is substantially in the closed state except for the ejecting outlet 6 as described above, the liquid flow does not move toward the liquid supply inlet 5 side. Accordingly, the bubble can expand largely toward the ejecting outlet 6 side but cannot expand so much toward the liquid supply inlet 5.

Figure 20D:
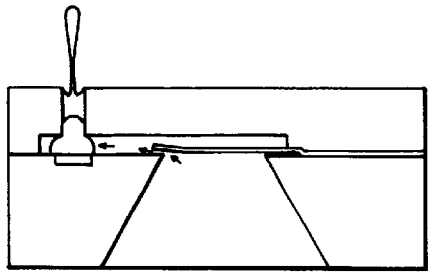
Figure 20D:
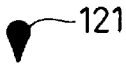

FIG. 20D shows the state in which the bubble continuously grows at the ejecting outlet 6 side in the bubble generating region 8, and in contrast, the bubble growth at the liquid supply inlet 5 side in the bubble generating region 8 stops.

That is, when the bubble growth stops as described above, the bubble at the ejecting outlet 6 side in the bubble generating region 8 expands maximally. The front end of the movable member 7 is located at the liquid supply inlet 5 side than the end of the bubble at the liquid supply inlet 5 side. Accordingly, the bubble generating efficiency is improved, and in addition, the refilling can be performed without being interrupted.

Subsequently, the free end of the movable member 7 starts to move upward to the position in the steady state due to the resilience caused by the stiffness of the movable member 7 and to the defoaming force of the bubble at the liquid supply inlet 5 side. As a result, the liquid supply inlet 5 opens, and hence, the common liquid supply chamber and the liquid flow path 3 communicate with each other.

Figure 20E:
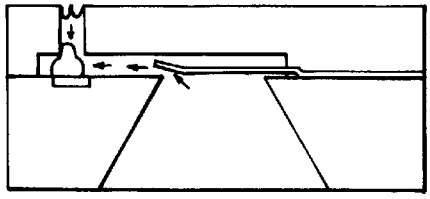

FIG. 20E shows the state of a defoaming step itself in which the growth of the bubble 121 stops and an ejected liquid droplet 122 is formed from the meniscus by cutting. Right after the change in state from the bubble growth to the defoaming, contractive energy of the bubble 121 works to move the liquid in the vicinity of the ejecting outlet 6 to the upstream side so as to maintain the balance of energy. Accordingly, the meniscus at the ejecting outlet 6 is pulled into the liquid flow path 3 at this moment, and hence, a liquid pillar connected to the liquid droplet 122 to be ejected is quickly cut therefrom by a strong force. In addition, the movable member 7 moves upward concomitant with the contraction of the bubble, the liquid in the common liquid supply chamber 6 rapidly forms a large stream flowing into the liquid flow path 3 via the liquid supply inlet 5. Accordingly, the flow rapidly pulling the meniscus into the liquid flow path 3 is quickly decreased, and with a decrease of recession of the meniscus, the meniscus starts to return at a relatively slow speed to the position before bubble generation. As a result, compared to a liquid ejecting method not using the movable member of the present invention, the convergence of meniscus vibration is significantly superior.

Figure 20F:
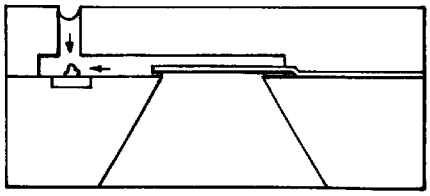

FIG. 20F finally shows the state in which the bubble 121 is completely defoamed, and the movable member 7 then returns to the position in the steady state shown in FIG. 20A. In the state described above, the movable member 7 moves upward due to the resilience thereof. In addition, the state described above, the meniscus has already returned to a position in the vicinity of the ejecting outlet 6.

Hereinafter, a method for manufacturing the liquid ejecting head of this embodiment will be described.

FIGS. 21A to 21F, 22A to 22E, 25A, 25B, and 26A to 26E are views for illustrating steps of the manufacturing method of the liquid ejecting head of this embodiment, a process for primarily manufacturing the substrate portion is shown in FIGS. 21A to 21F, a process for manufacturing the movable members on the substrate using a photolithographic method is shown in FIGS. 22A to 22E, a process for manufacturing the ejecting outlets, the liquid supply inlet, and ejecting outlet forming member is shown in FIGS. 25A, 25B, and 26A to 26E so that the structure of the semiconductor device according to the present invention is understood.

Figure 21A:
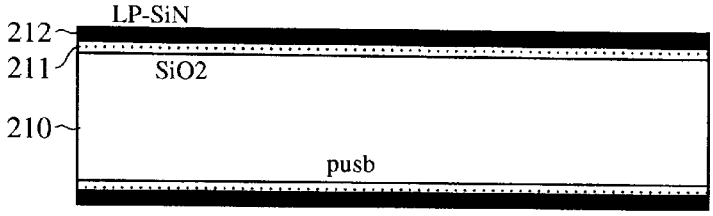
FIGS. 21A to 21F are cross-sectional views for illustrating steps of a manufacturing method for a substrate of a liquid ejecting head according to the first embodiment of the present invention.

First, a p-type silicon wafer 210 having the (100) crystal plane and a thickness of 625 $\mu$m used as a substrate is prepared and is then thermally oxidized to form a silicon oxide film 211 having a thickness of 100 to 500 Å on the silicon substrate. In addition, on the silicon oxide film 211, a silicon nitride film 212 having a thickness of 1,000 to 3,000 Å is deposited by low pressure CVD (FIG. 21A).

Figure 21B:
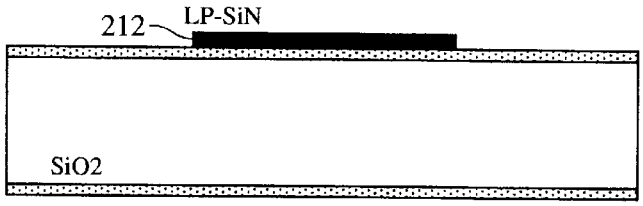

Next, the silicon nitride film 212 is patterned so as to remain in the vicinity of an area at which the sacrifice layer is formed. In the step described above, a silicon nitride film formed on the rear side of the silicon substrate is completely removed by etching for this patterning (FIG. 21B).

Figure 21C:
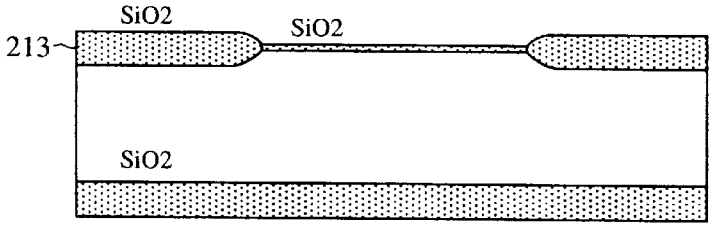

By thermally oxidizing the silicon substrate, a silicon oxide film 213 having a thickness of 6,000 to 12,000 Å on the surface of the substrate. In this step, the silicon oxide film under the silicon nitride film formed by patterning is not oxidized, the silicon oxide film 213 which is not covered with the silicon nitride film is selectively oxidized so that the thickness of the silicon oxide film is increased in the upward and the downward directions, and as a result, the height of the silicon oxide film becomes larger than that of the silicon nitride film. Subsequently, the silicon nitride film is removed by etching (FIG. 21C).

Figure 21D:
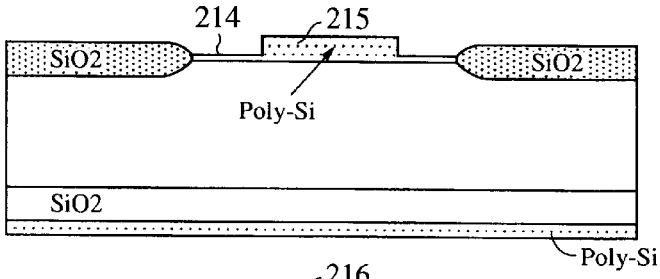

Patterning and etching are performed on a silicon oxide film 214 which was under the silicon nitride film 212 so as to form an opening, thereby exposing the surface of the silicon substrate. Next, a polysilicon film 215 used as the sacrifice layer is formed on the exposed silicon substrate. The patterned width of the polysilicon film 215 will correspond to the width of the liquid supply inlet formed by a subsequent process. The patterned width will be described later (FIG. 21D).

Figure 21E:
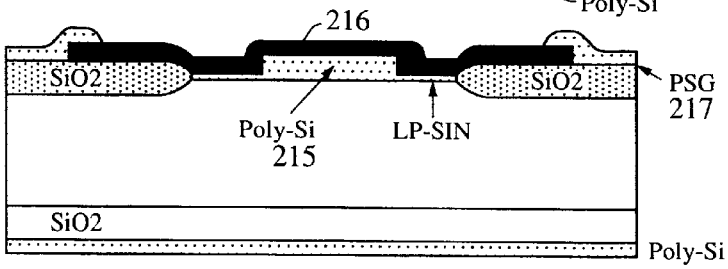

A silicon nitride film (LP-SiN) 216 having a thickness of 500 to 2,000 Å is formed by low pressure CVD, and a pattern is then formed so that the silicon nitride film (LP-SiN) 216 only remains on a membrane portion (vicinity of the sacrifice layer). Next, a PSG film 217 is formed by atmospheric CVD and is then processed to form a desired pattern. An Al—Cu film (not shown) used as wiring electrodes is deposited on the PSG film 217 and is then processed to form a desired pattern. By the steps described above, an active element driven for ejecting liquid is completed (FIG. 21E). In this embodiment, the active element is not shown by this step, and a portion at which the liquid supply inlet 5 is to be formed is only shown (FIGS. 21A to 21E).

Next, a silicon oxide film (p-SiO) 218 having a thickness of 1.0 to 1.8 $\mu$m is formed by plasma CVD and is then processed to form a desired pattern.

Subsequently, a resist such as OFPR is applied to the silicon nitride film, and after poly(ether amide) used as a mask for anisotropic etching is applied to the rear side of the substrate, the resist is heated at 200° C. and is then patterned.

A TaN film 219 having a thickness of approximately 200 to 1,000 Å, which is used for a heat generating element 4, is formed on the silicon oxide film (p-SiO) 218 by reactive sputtering and is then processed to form a desired pattern. A silicon nitride film (p-SiN) 220 having a thickness of approximately 6,000 to 12,000 Å, which is used as a protection film for the heat generating element 4, is formed by plasma CVD.

Figure 21F:
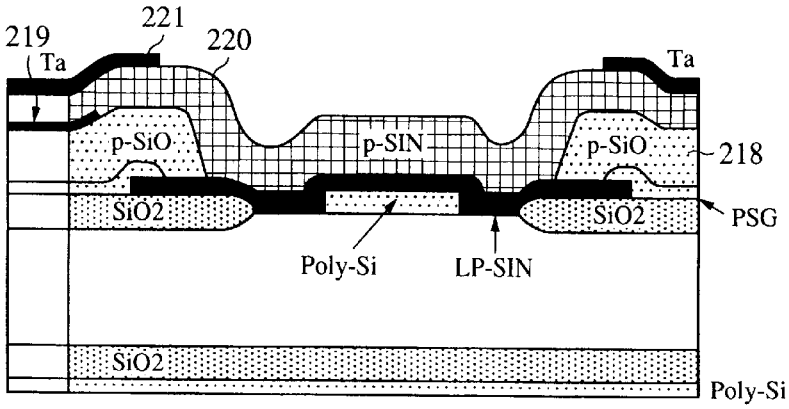

A Ta film 221 having a thickness of approximately 200 to 1000 Å, which is used for anticavitation, is formed by sputtering. Next, after this Ta film 221 is processed to form a desired pattern, patterning is performed for forming leads for electrodes (FIG. 21F).

Next, a method for manufacturing movable members on the substrate using a photolithographic process will be described.

Figure 22A:
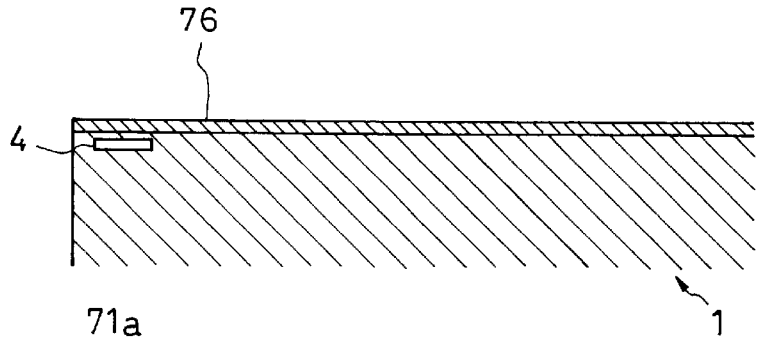
FIGS. 22A to 22E are cross-sectional views for illustrating steps of a manufacturing method for a movable member on the substrate by using a photolithographic process performed for forming the liquid ejecting head according to the first embodiment of the present invention.

As shown in FIG. 22A, a TiW film 76 having a thickness of approximately 5,000 Å, which is used as a first protection layer for protecting a connection pad portion which is electrically connected to the heat generating element 4, is formed over the entire surface of the substrate 1 at the heat generating element 4 side by sputtering.

Figure 22B:
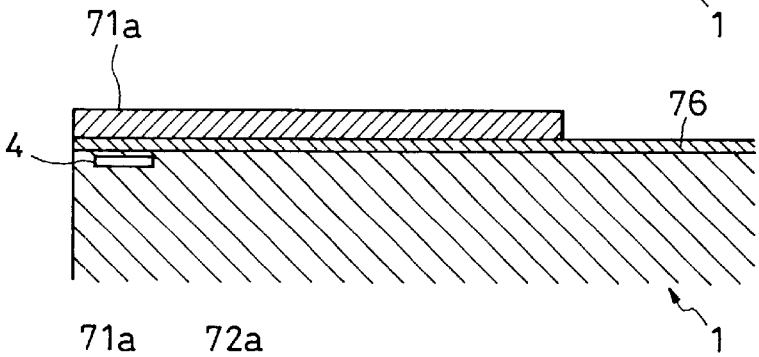

As shown in FIG. 22B, an Al film having a thickness of approximately 3 μm, which is used for forming a space forming member 71*a,* is formed on the surface of the TiW film 76 by sputtering. The space forming member 71*a* is formed to extend to an area at which a SiN film 72*a* will be etched in the step shown in FIG. 22D described below.

The Al film thus formed is patterned by a known photolithographic process so that a part of the Al film corresponding to the supporting portion of the movable member 7 is removed, thereby forming the space forming member 71a on the surface of the TiW film 76. Accordingly, a part of the surface of the TiW film 76 corresponding to an area of the supporting portion of the movable member 7 is exposed. This space forming member 71*a* is used for forming the space between the substrate 1 and the movable member 7 and is composed of an Al film. The space forming member 71*a* is formed over the entire surface of the TiW film including areas corresponding to the bubble generating regions 8 between the heat generating elements 4 and the movable members 7 except for areas corresponding to the supporting portions of the movable members 7. Accordingly, in this manufacturing method, the space forming member 71*a* is formed on the surface of the TiW film 76 corresponding to areas at which walls of the liquid flow paths 3 are formed.

This space forming member 71*a* serves as an etching stopper layer when the movable member 7 is formed by dry etching as described below. Since the TiW film 76, the Ta film used as the anticavitation film and provided on the substrate 1, and the SiN film used as the protection layer over the heat generating element are etched by etching gas used for etching the movable member 7, in order to prevent these films and layers from being etched, the space forming member 71*a* described above is formed on the substrate 1. Accordingly, when dry etching is performed on the SiN film for forming the movable member 7, since the surface of the TiW film is not exposed, damage done to the TiW film and the functional element on the substrate 1 can be avoided by the presence of the space forming member 71*a*.

Figure 22C:
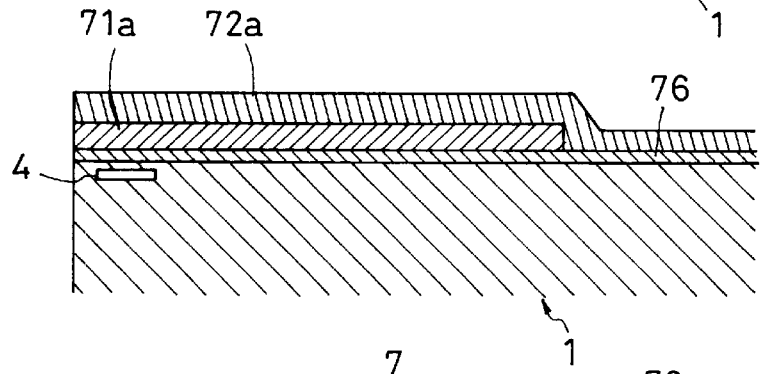

As shown in FIG. 22C, a SiN film 72*a* having a thickness of approximately 3 μm, which is a film for forming the movable member 7, is formed by plasma CVD on the entire surface of the space forming member 71*a* and the entire exposed surface of the TiW film 76 so as to cover the space forming member 71*a*. When the SiN film 72*a* is formed by using a plasma CVD apparatus, as described below with reference to FIG. 23, the anticavitation film composed of Ta provided for the substrate 1 is grounded via the silicon wafer forming the substrate 1 or the like. Accordingly, the heat generating element 4 and the functional element such as a latch circuit on the substrate 1 can be protected from the attack of charges of ions and/or radicals formed by decomposition due to plasma discharge in a reactor of the plasma CVD apparatus.

Figure 23:
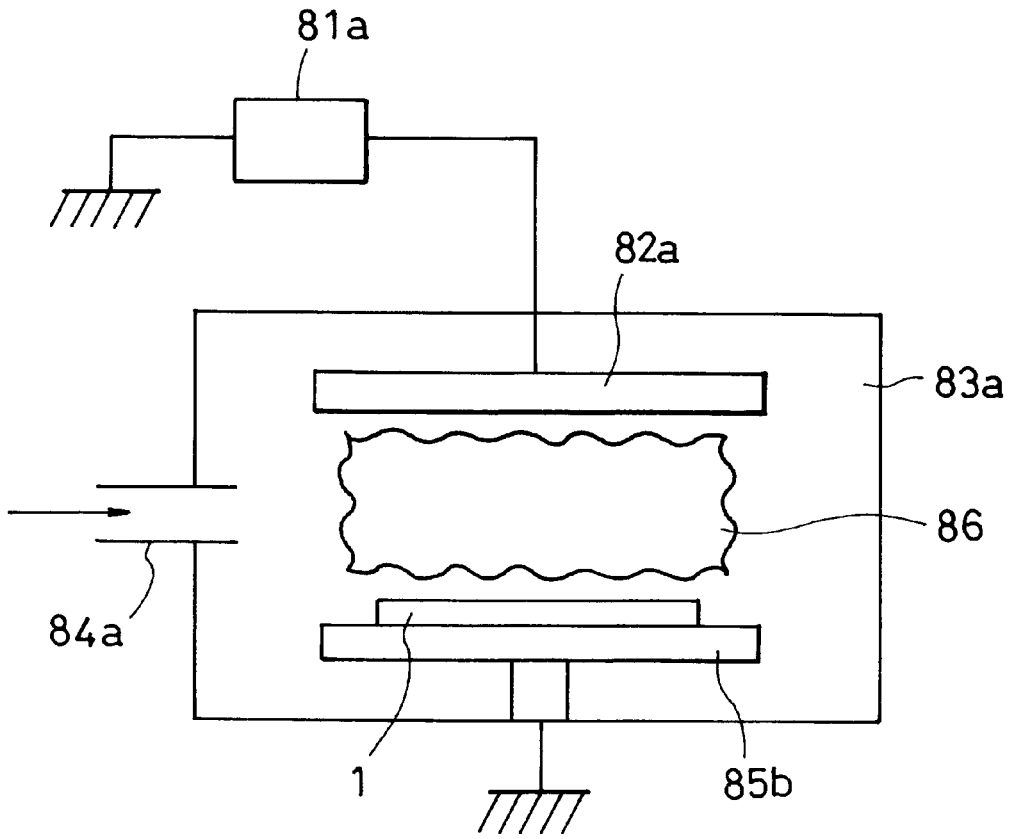
FIG. 23 is a schematic view showing an example of a plasma CVD apparatus used in the present invention.

As shown in FIG. 23, in a reactor 83*a* of the plasma CVD apparatus for forming the SiN film 72*a,* an RF electrode 82*a* and a stage 85*a* are disposed so as to oppose each other at a predetermined distance therebetween. An RF power source 81*a* provided outside the reactor 83*a* applies a voltage to the RF electrode 82*a*. The substrate 1 is placed on the surface of the stage 85*a* at the RF electrode 82*a* side, and the surface of the substrate 1 at the heat generating element 4 side opposes the RF electrode 82*a*. The anticavitation film composed of Ta formed on the heat generating element 4 is electrically connected to the silicon wafer forming the substrate 1, and the space forming member 71*a* is grounded via the silicon wafer forming the substrate 1 and the stage 85*a*.

In the plasma CVD apparatus thus formed, in the state in which the anticavitation film is grounded, a gas is supplied into the reactor 83*a* via a supply tube 84*a,* and plasma 46 is generated between the substrate 1 and the RF electrode 82*a*. Ion species and radicals formed by decomposition due to plasma discharge in the reactor 83*a* are deposited on the substrate 1, and hence, the SiN film 72*a* is formed on the substrate 1. In the step described above, charges are generated on the substrate 1 due to the generation of the ion species and radicals; however, since the anticavitation film is grounded as described above, the heat generating element 4 and the functional element such as a latch circuit on the substrate 1 are protected from being damaged by the charges of the ion species and radicals.

Figure 22D:
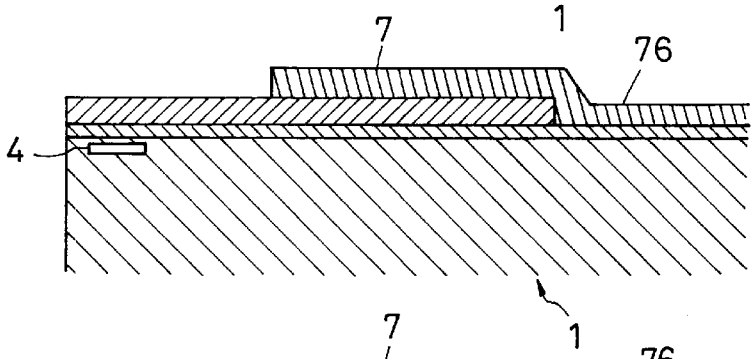

Next, as shown in FIG. 22D, after an Al film approximately 5,000 Å thick is formed on the surface of the SiN film 72*a* by sputtering, the Al film thus formed is patterned by a known photolithographic process so as to form Al films (not shown) as a second protection layer on the surface of the SiN film 72*a* corresponding to areas at which the movable members 7 are formed. This Al film used as the second protection layer serves as a mask, that is, as a protection layer (etching stopper layer) when dry etching is performed on the SiN film 72*a* for forming the movable member 7.

When the SiN film 72*a* is patterned using the second protection layer as a mask by an etching apparatus using induction coupled plasma, movable members 7 formed of remaining SiN film 72*b* are obtained. In this etching apparatus, a mixed gas of $CF_4$ and $O_2$ is used, and in the step of patterning the SiN film 72*a,* as shown in FIG. 1, unnecessary parts of the SiN film 72*a* are removed so that the supporting portions of the movable members 7 are directly fixed to the substrate 1. A material for forming the bonded portion of the supporting portion and the substrate 1 contains TiW which is a material forming a pad protection layer and Ta which is a material forming the anticavitation film provided for the substrate 1.

When the SiN film 72*a* is etched by using a dry etching apparatus, as described below with reference to FIG. 24, the space forming member 71*a* is grounded via the substrate 1 or the like. Accordingly, charges of ions and/or radicals formed by decomposition of $CF_4$ gas during etching cannot stay on the space forming member 71*a,* and hence, the heat generating element 4 and the functional element, such as a latch circuit, can be protected. In addition, in this etching step, when the unnecessary parts of the SiN film 72*a* are removed, the space forming member 71*a* is exposed, that is, the surface of the TiW film 76 is not exposed since being covered with the space forming member 71*a,* whereby the substrate 1 is reliably protected by the space forming means 71*a*.

Figure 24:
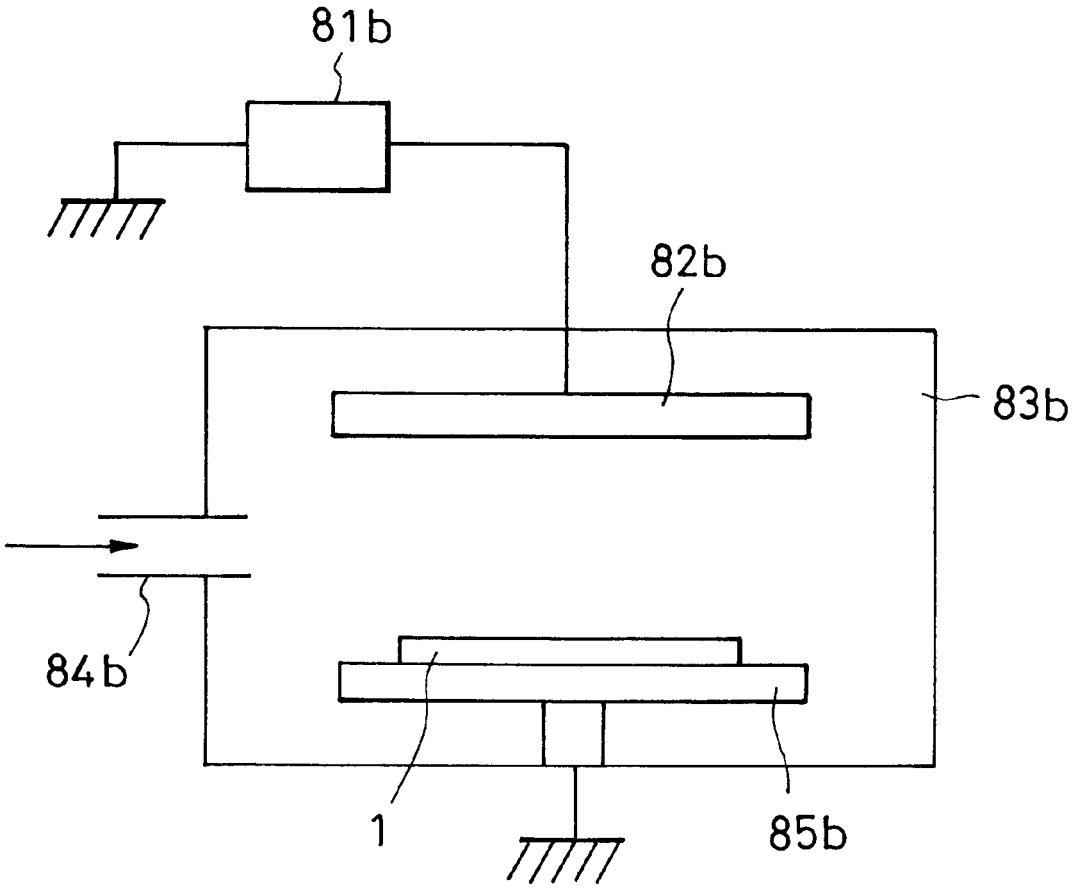
FIG. 24 is a schematic view showing an example of a dry etching apparatus used in the present invention.

As shown in FIG. 24, in a reactor 83*b* of the dry etching apparatus for etching the SiN film 72*a,* an RF electrode 82*b* and a stage 85*b* are disposed so as to oppose each other at a predetermined distance therebetween. An RF power source 81*b* provided outside the reactor 83*b* applies a voltage to the RF electrode 82*b*. The substrate 1 is placed on the surface of the stage 85*b* at the RF electrode 82*b* side, and the surface of the substrate 1 at the heat generating element 4 side opposes the RF electrode 82*b*. The space forming member 71*a* composed of an Al film is electrically connected to the anticavitation film 221 composed of Ta and provided for the substrate 1, the anticavitation film 221 is electrically connected to the silicon wafer forming the substrate 1, and the space forming member 71*a* is grounded via the anticavitation film of the substrate 1, the silicon wafer, and the stage 85*b*.

In the dry etching apparatus having the structure described above, in the state in which the space forming member 71*a* is grounded, a mixed gas of $CF_4$ and $O_2$ is supplied into the reactor 83*b* via a supply tube 84*b* so as to etch the SiN film 72*a*. In the step described above, charges are generated on the substrate 1 by ion species and radicals formed by decomposition of $CF_4$; however, since the space forming member 71*a* is grounded as described above, the heat generating element 4 and the functional element such as a latch circuit on the substrate 1 are protected from being damaged by the charges of the ion species and radicals.

In this embodiment, as the gases supplied into the reactor 83*b*, a mixed gas of $CF_4$ and $O_2$ is used; however, a $CF_4$ gas or $C_2F_6$ gas containing no $O_2$, or a mixed gas of $C_2F_6$ and $O_2$ may also be used.

Figure 22E:
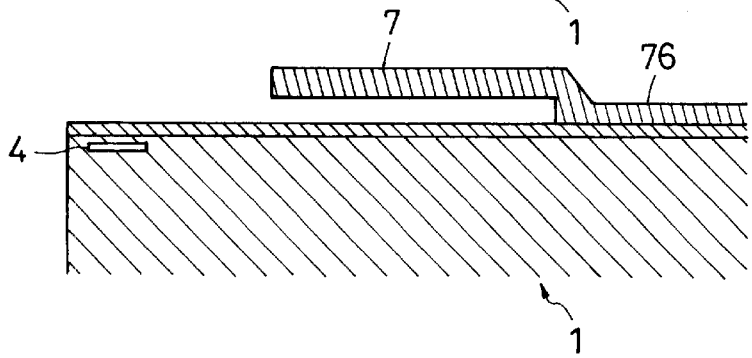

Next, as shown in FIG. 22E, the second protection layer composed of the Al film used for forming the movable member 7 and the space forming member 71*a* composed of the Al film are dissolved and removed by using a mixed acid composed of acetic acid, nitric acid, and phosphoric acid, so that the movable member 7 is formed on the substrate 1. Subsequently, areas of the TiW film 76 formed on the substrate 1 corresponding to the bubble generating region 8 and the pad are removed by using hydrogen peroxide.

Figure 25A:
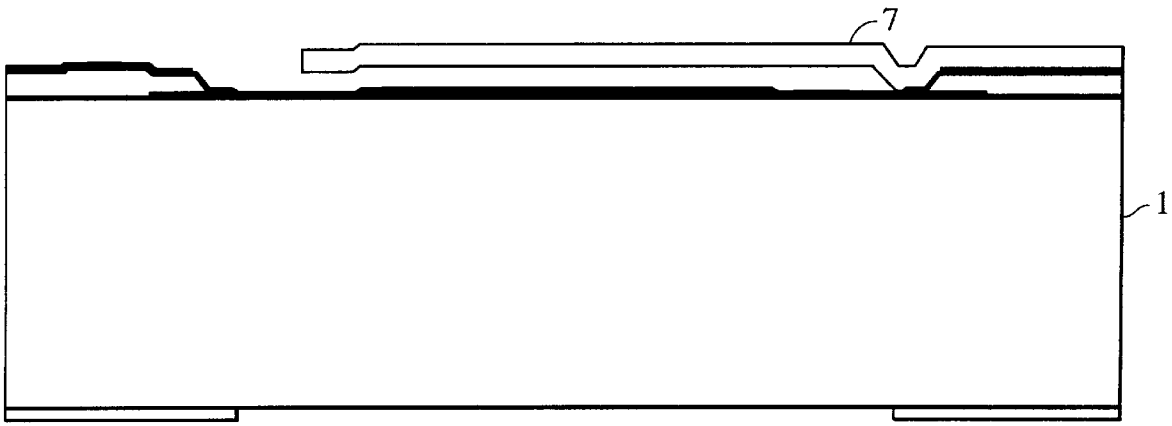
FIGS. 25A and 25B are cross-sectional views for illustrating steps of manufacturing methods for an ejecting outlet, a liquid supply inlet, and an ejecting outlet forming member of the liquid ejecting head according to the first embodiment of the present invention.

By the steps described above, the substrate 1 provide with the movable members 7 is formed (FIG. 25*a*).

Subsequently, a positive-type thick film resist: ODUR (a mixed solution of polymethylisopropenylketone and chlorohexanone) approximately 15 $\mu$m thick is applied to the substrate 1 for forming a pattern of the liquid flow paths, and exposure at a wavelength region of approximately 290 nm followed by development is performed, thereby forming an optional pattern corresponding to the shape of the liquid flow path 3.

Figure 25B:
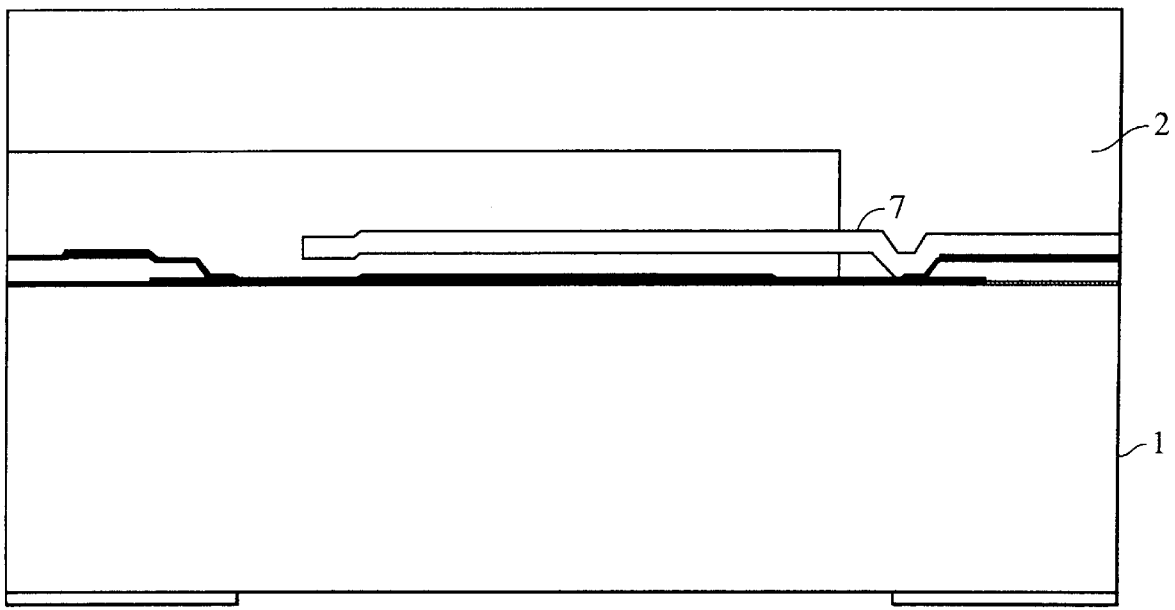

Next, on the substrate 1 provided with the movable members 7 and the patterned material described above, a negative-type photosensitive epoxy resin 50 $\mu$m thick is applied by spin coating (FIG. 25B).

Subsequently, a material for forming the ejecting outlet forming member 2, that is, a material for forming walls of the liquid flow paths, according to the present invention will be described. As the material for forming the wall, since a liquid flow path can be easily and precisely formed by a photolithographic technique, a photosensitive resin is preferably used. In addition to superior mechanical strength as a structural material, superior adhesion to the substrate 1, superior ink resistance, a photosensitive resin used for this purpose must have superior photosensitivity so as to obtain a fine liquid flow path pattern having a high aspect ratio with high resolution. Through intensive research by the inventors of the present invention, it was discovered that an epoxy resin cured by cationic polymerization had superior strength as a structural material, adhesion, and ink resistance, and that when the epoxy resin is a solid form at room temperature, a superior patterning property can also be obtained. When an epoxy resin is solid at room temperature, a solution containing the epoxy resin is used for coating.

Since an epoxy resin cured by cationic polymerization has a high crosslinking density (a high glass transition temperature) compared to an epoxy resin cured by using a general acid anhydride or an amine, the epoxy resin cured by cationic polymerization has superior properties as a structural material.

In addition, since an epoxy resin in a solid form at room temperature is used, the diffusion of initiator species derived from a polymerization initiator by light irradiation can be suppressed, and hence, superior patterning accuracy and patterned shape can be obtained.

Figure 26A:
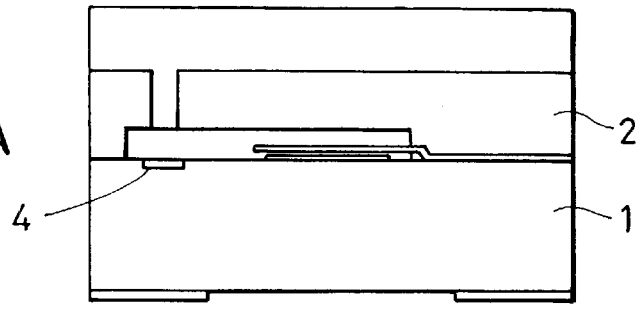
FIGS. 26A to 26E are cross-sectional views for illustrating the steps of the manufacturing methods for the ejecting outlet, the liquid supply inlet, and the ejecting outlet forming member of the liquid ejecting head according to the first embodiment of the present invention.
Figure 26B:
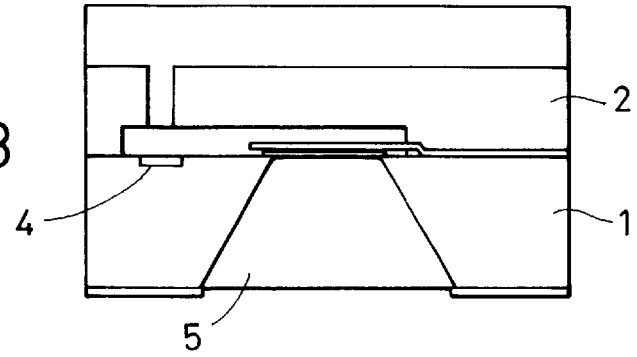

Subsequently, a photosensitive epoxy resin 100 is prebaked at 90° C. for 5 minutes and is then exposed and developed at an exposure amount of 2 J/cm$^2$ by using an exposure apparatus (MPA 600), thereby forming ejecting outlet 6. Next, OBC used as a protection film during anisotropic etching is applied to the front surface side of the wafer (FIG. 26A), and the wafer is etched anisotropically from the rear side thereof using the mask provided thereon so as to form the liquid supply inlet 5 for supplying liquid from the rear side of the substrate (FIG. 26B). In this step, the mask widths for forming the widths of the sacrifice layer and the liquid supply inlet 5 are 145 $\mu$m and 500 to 700 $\mu$m, respectively. However, these dimensions may be optionally determined in accordance with applications of the products and may vary concomitant with the change in thickness of the Si wafer or the like. In addition, an etching solution used for this anisotropic etching is a TMAH aqueous solution, and the time for etching is 15 to 20 hours when the temperature of the etching solution is 80 to 90° C. and the thickness of the Si substrate is approximately 625 $\mu$m.

Figure 26C:
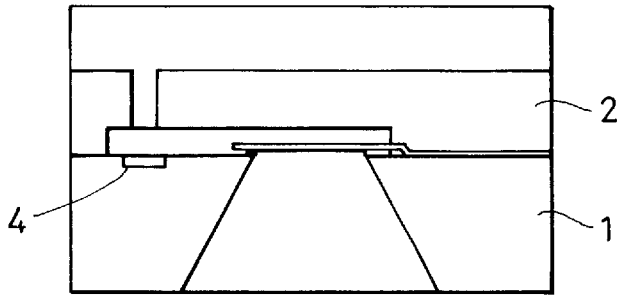

Next, after the substrate is etched anisotropically, a membrane portion 226 which is present at the liquid supply inlet area and is composed of the silicon nitride (LP-CVD) 216 and the silicon nitride film (p-SiN) 220 is removed by dry etching using fluorine-based and oxygen-based gases (FIG. 26C).

In the step described above, the ODUR layer described above serves as an etching stopper film for the movable member, and the silicon nitride film forming the movable member is protected thereby.

Figure 26D:
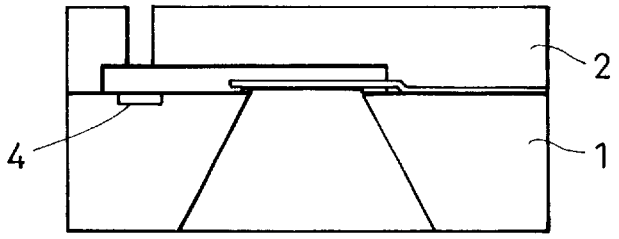
Figure 26E:
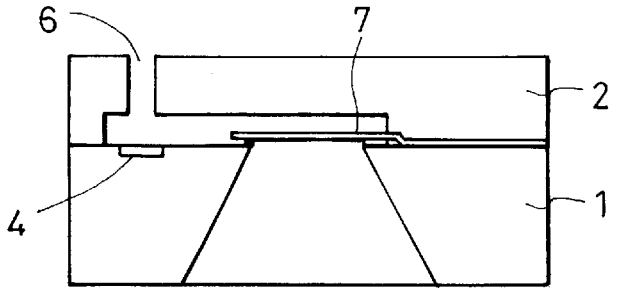

Next, the OBC layer on the front surface side of the wafer is removed (FIG. 26D).

Subsequently, the entire wafer surface is exposed by light in a wavelength region of approximately 350 nm, and the ODUR, which is used for forming the pattern of the liquid flow paths, is then removed by using 4-methyl-2-pentanone as a developer, thereby forming the liquid ejecting head of this embodiment.

(Second Embodiment)

Figure 9:
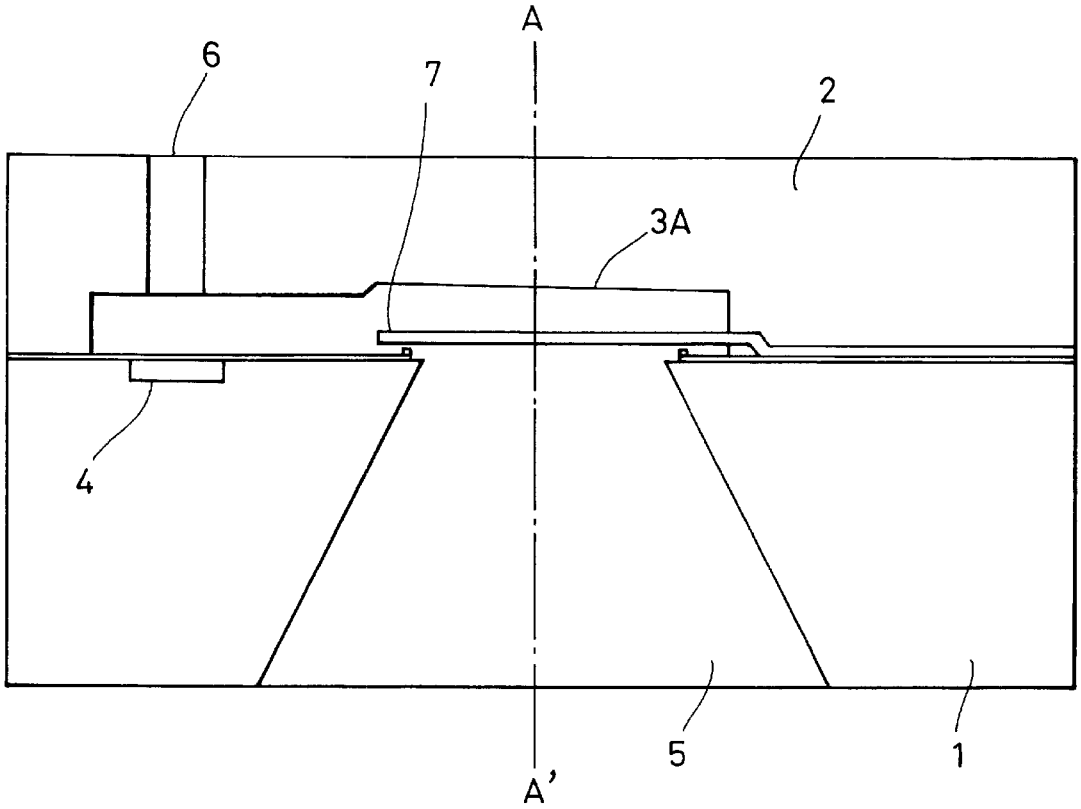
FIG. 9 is a cross-sectional view showing a liquid ejecting head in the direction of one liquid flow path according to a second embodiment of the present invention.
Figure 10:
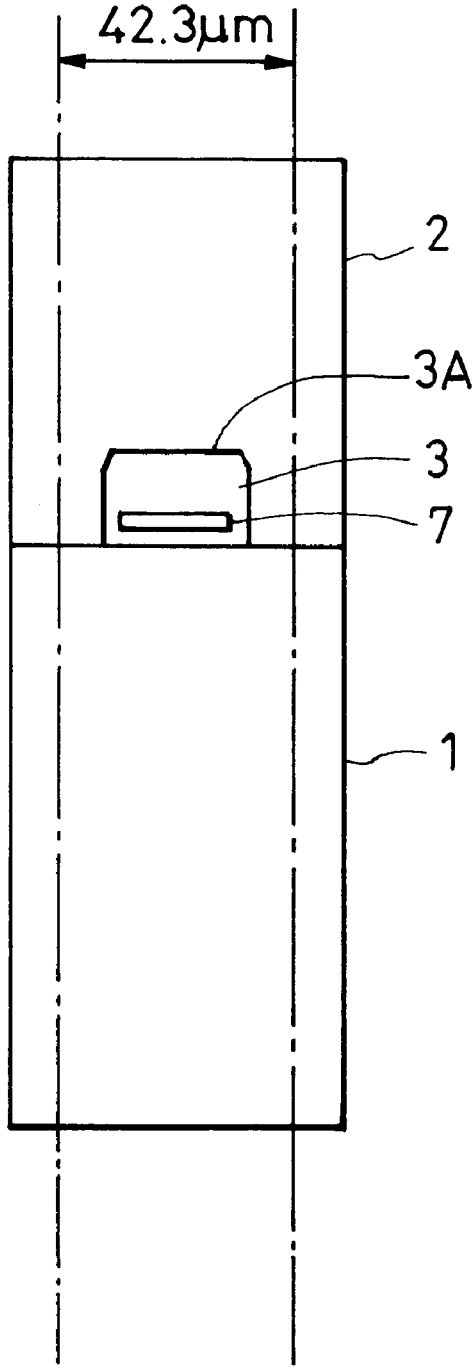
FIG. 10 is a cross-sectional view taken along the line A–A' in FIG. 9.

FIGS. 9 and 10 are views for illustrating a second embodiment of the present invention. FIG. 9 is a cross-sectional view of a liquid ejecting head in the liquid flow path direction according to this embodiment and corresponds to FIG. 4 of the first embodiment. FIG. 10 is a cross-sectional view taken along the line A–A' in FIG. 9 and corresponds to FIG. 5.

As shown in FIGS. 9 and 10, the liquid ejecting head of the second embodiment has the same structure as that of the first embodiment except that a portion of the liquid flow path 3 above the movable member 7 has a convex curvature along the periphery of the movable member 7.

Figure 11:
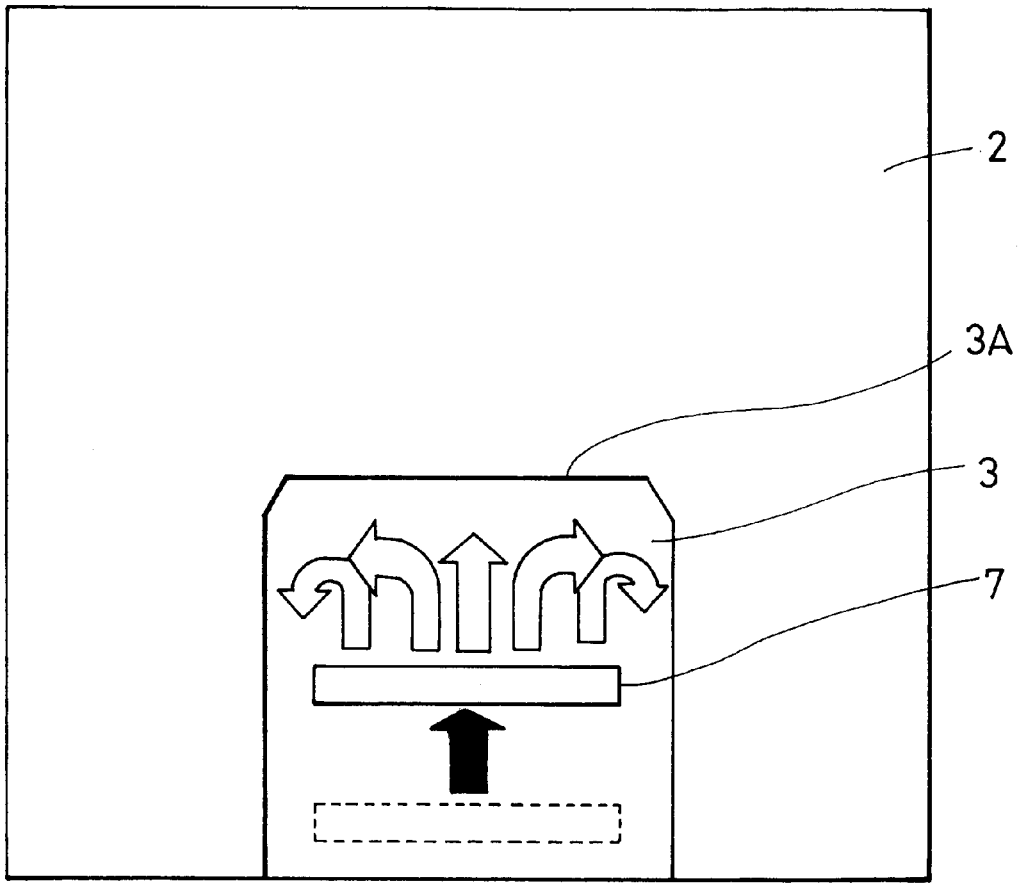
FIG. 11 is an enlarged schematic view of a part of the liquid ejecting head shown in FIG. 10.
Figure 12:
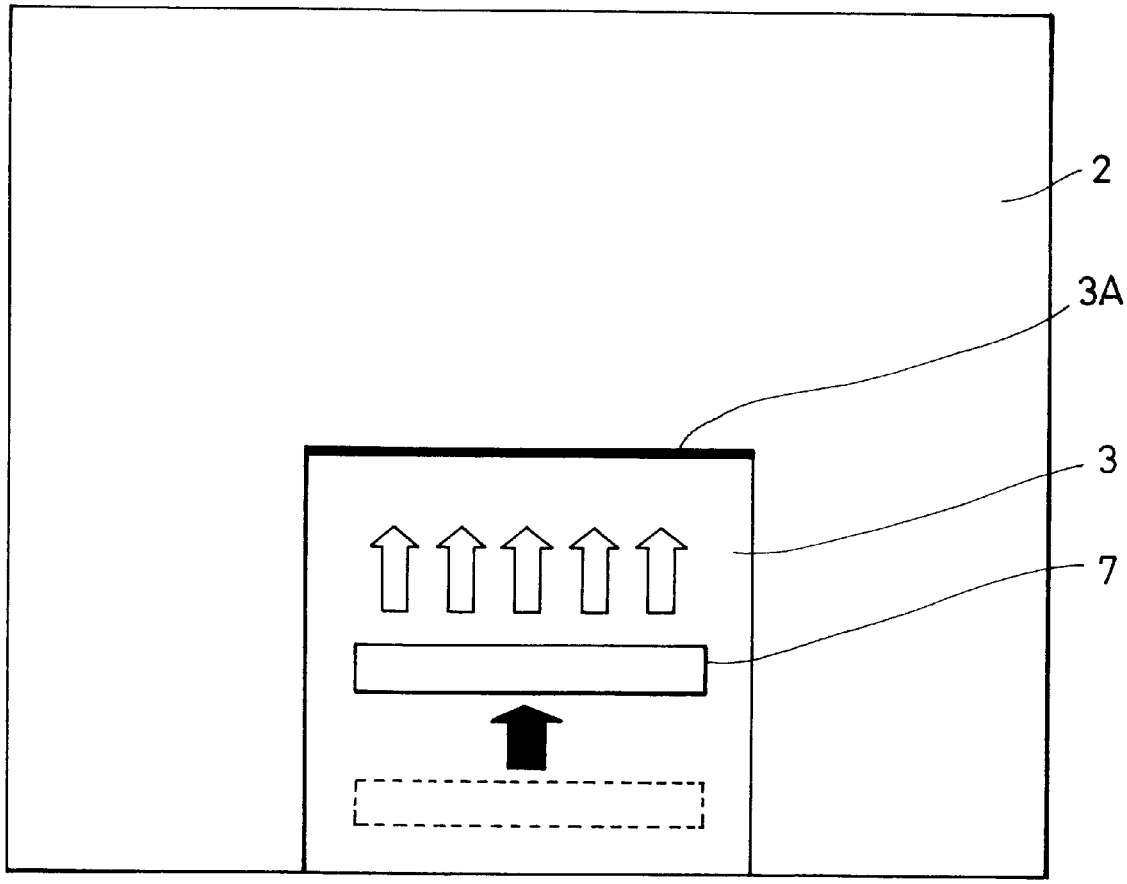
FIG. 12 is a schematic view corresponding to the liquid ejecting head shown in FIG. 9 according to the first embodiment of the present invention.

FIG. 11 is a schematic and enlarged view of an area around the liquid flow path 3 shown in FIG. 10 for illustrating the feature of this embodiment. In this embodiment, as shown in FIG. 11, when the movable member 7 is displaced upward, a liquid flow along the curvature of the liquid flow path 3 occurs, that is, a downward liquid flow is likely to occur. Accordingly, concentration of the pressure on a ceiling portion 3A of the liquid flow path 3 can be reduced. In contrast, FIG. 12 shows a ceiling portion of a liquid flow path 3, which is located above the movable member 7 and is provided with no curvature along the periphery of the movable member 7. According to this structure, compared to the structure shown in FIG. 11, a downward liquid flow is not likely to occur, and as a result, a pressure perpendicular to the ceiling portion 3A of the liquid flow path 3 is easily applied thereto.

(Third Embodiment)

Figure 13:
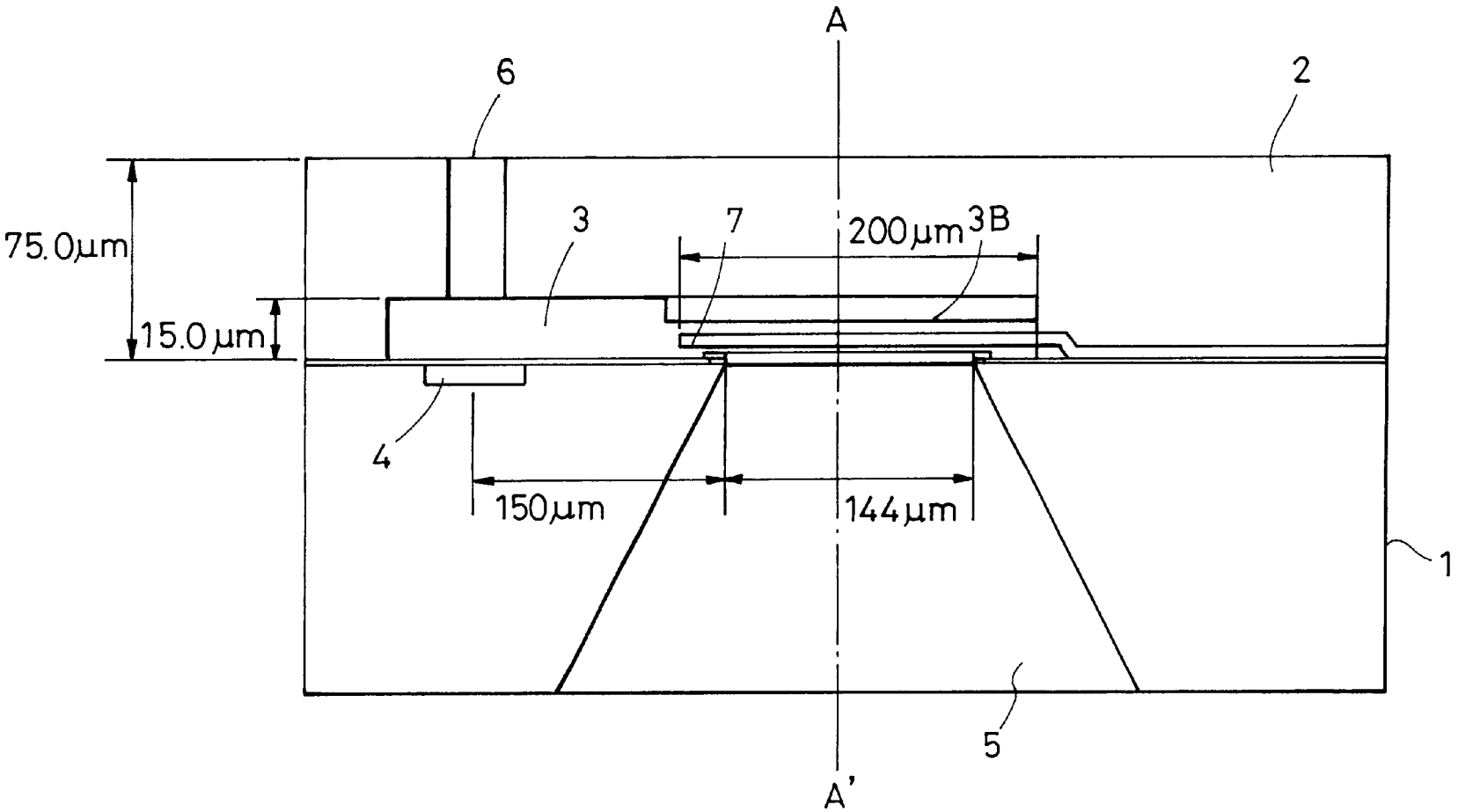
FIG. 13 is a cross-sectional view showing a liquid ejecting head in the direction of one liquid flow path according to a third embodiment of the present invention.
Figure 14:
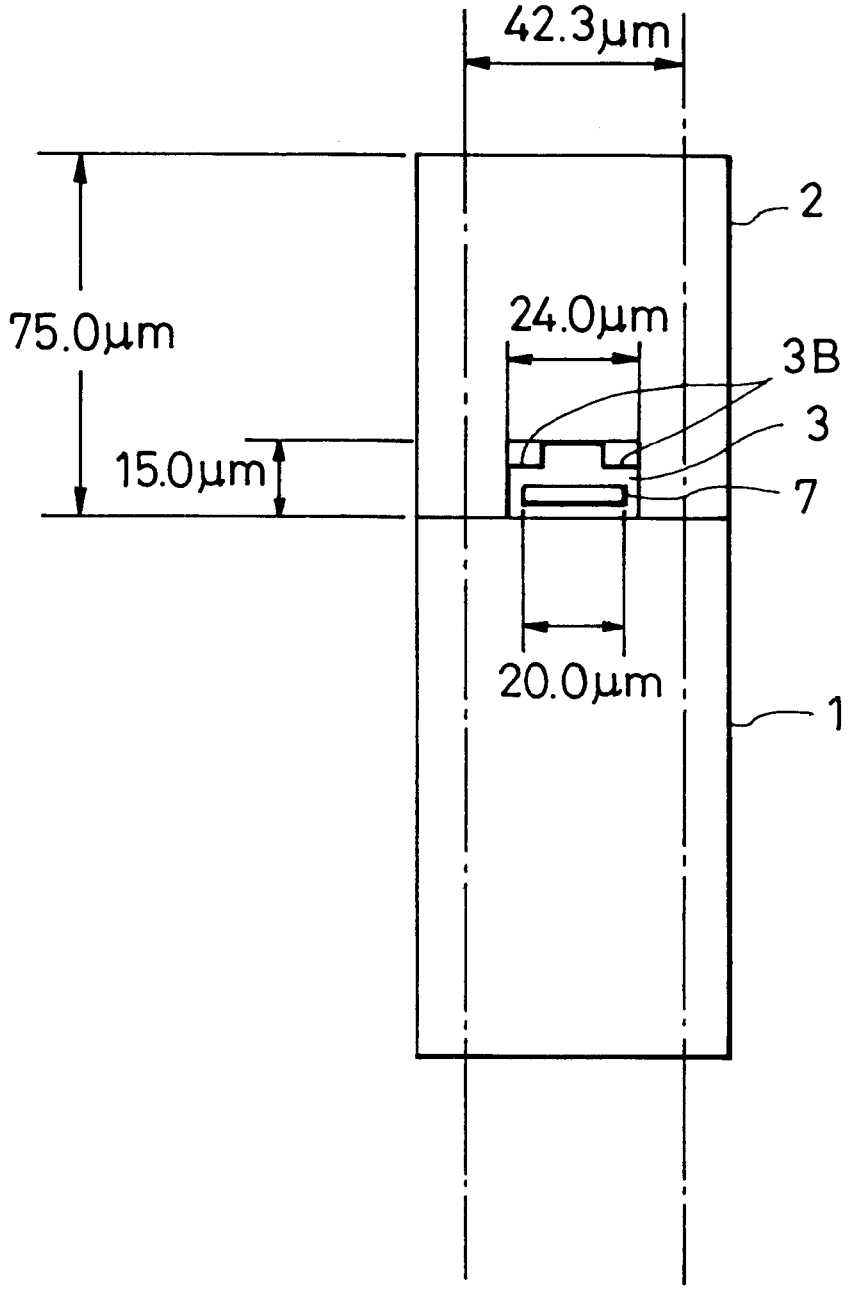
FIG. 14 is a cross-sectional view taken along the line A–A' in FIG. 13 for illustrating a first example of the third embodiment of the present invention.
Figure 15:
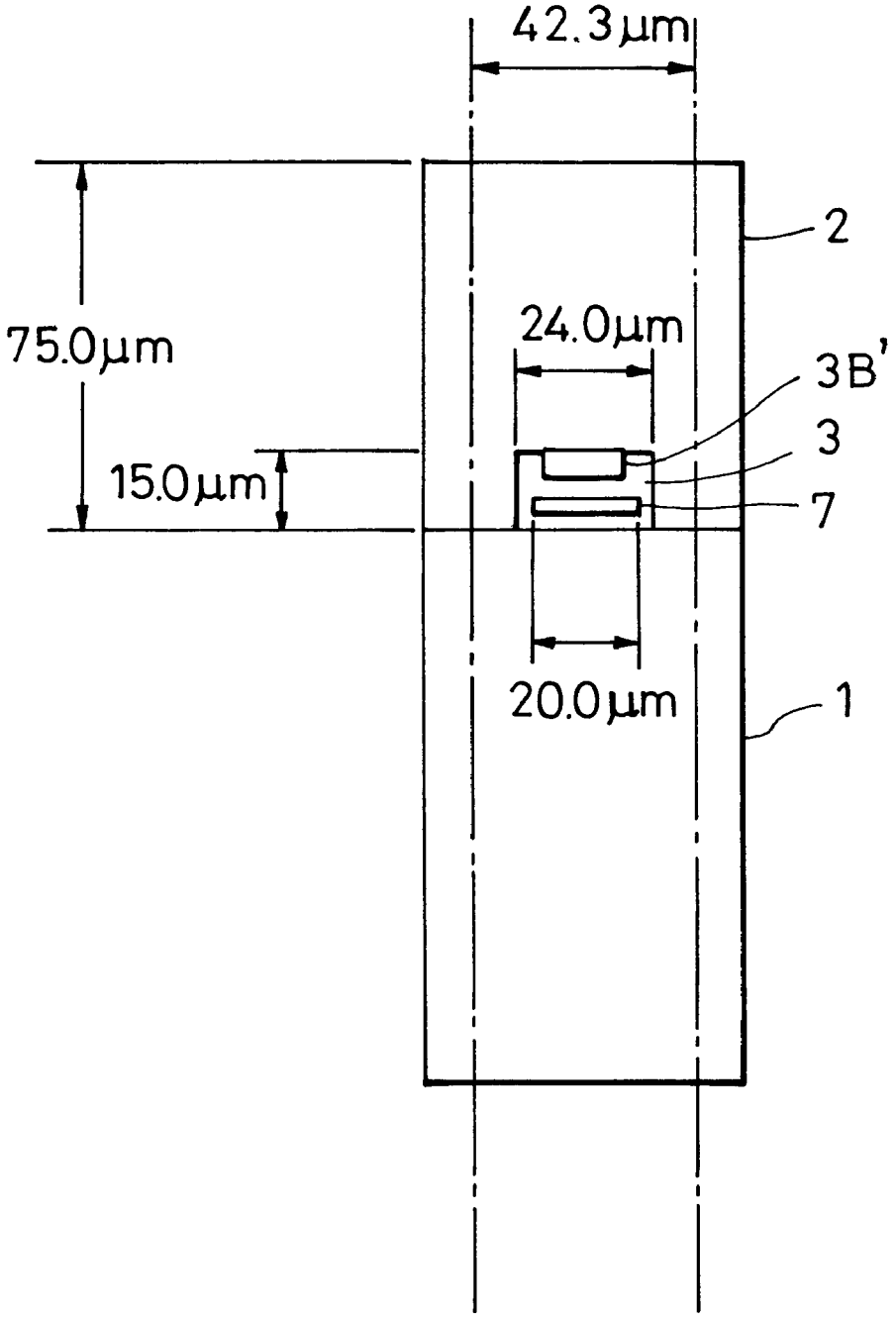
FIG. 15 is a cross-sectional view of an area around a liquid flow path taken along the line A–A' in FIG. 13 for illustrating a second example of the third embodiment of the present invention.

FIGS. 13 to 15 are views for illustrating a third embodiment of the present invention. FIG. 13 is a view corresponding to FIG. 4 of the first embodiment, and FIGS. 14 and 15 are each cross-sectional view taken along the line A–A' in FIG. 11 and correspond to FIG. 5. FIGS. 14 and 15 are views for illustrating the first embodiment and the second embodiment, respectively.

As shown in FIGS. 13 to 15, in a liquid ejecting head according to the third embodiment, a portion of the liquid flow path 3 corresponding to an area at which the movable member 7 is disposed has a two-step structure.

In the structure of a liquid ejecting head according to a first example of this embodiment shown in FIG. 14, the height of ceiling portions 3B of the liquid flow path 3 corresponding to the side end portions of the movable member are low, and in the structure of a liquid ejecting head according to a second example of this embodiment shown in FIG. 15, the height of a ceiling portion 3B' of the liquid flow path 3 corresponding to the central portion of the movable member in the width direction is low.

Figure 16:
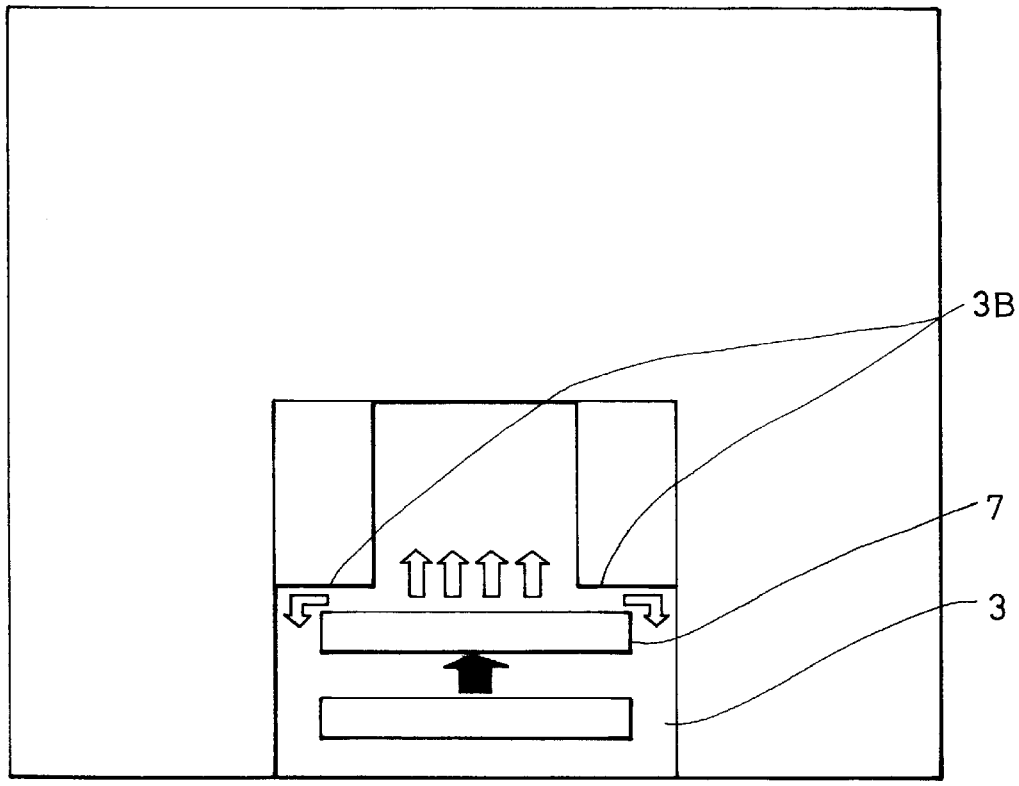
FIG. 16 is an enlarged schematic view of the area around the liquid flow path shown in FIG. 15.

FIG. 16 is a schematic and enlarged view of an area around the liquid flow path 3 shown in FIG. 14. As shown in FIG. 16, when the liquid flow path 3 has the structure described above, the amount of upward displacement of the movable member 7 can be controlled, and a pressure applied to the ceiling portion 3A of the liquid flow path 3 can be reduced. These effects can be equally obtained by both structures of the liquid ejecting heads shown in FIGS. 14 and 15.

(Fourth Embodiment)

Figure 17:
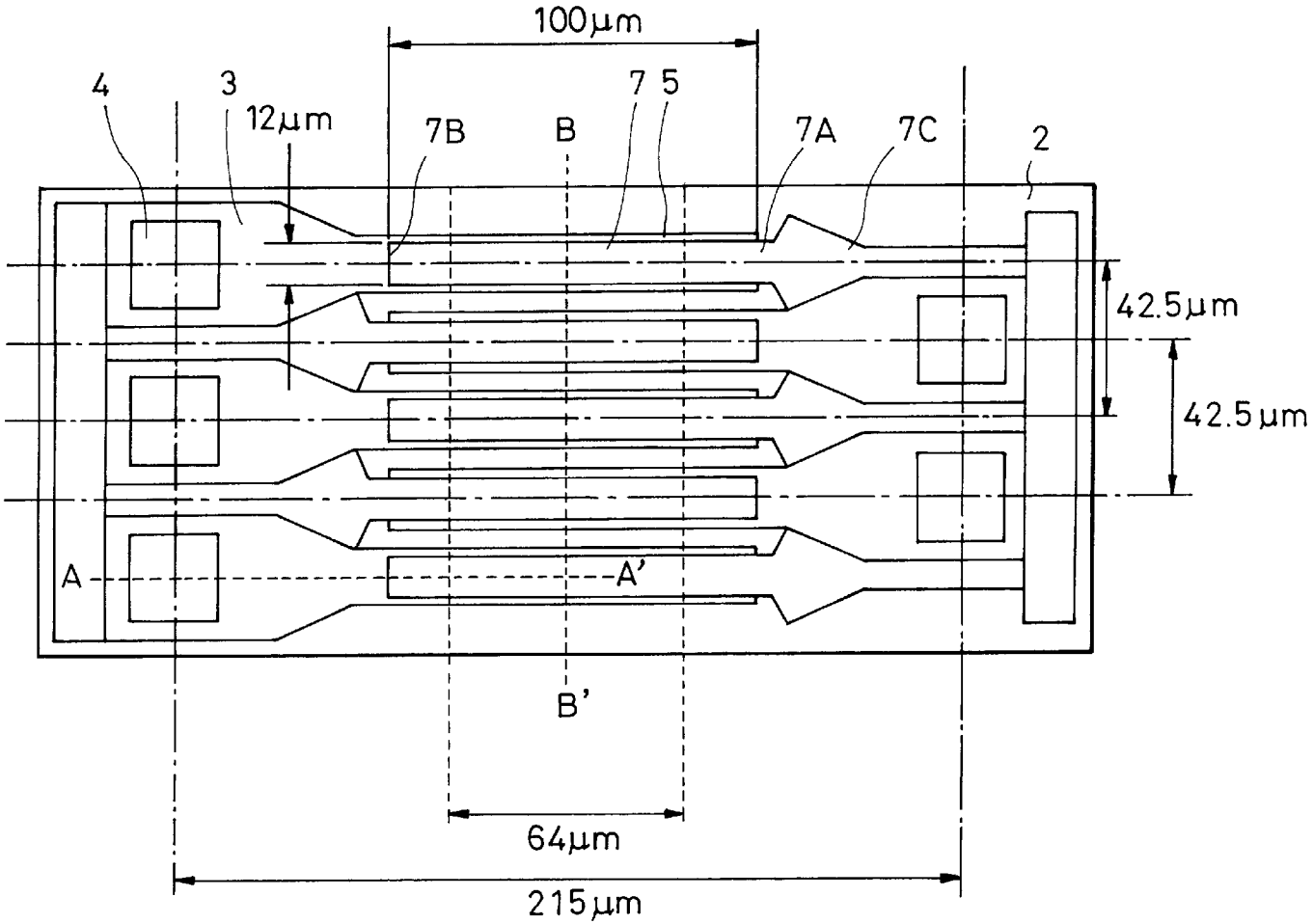
FIG. 17 is a cross-sectional view showing a liquid ejecting head in the direction of liquid ejection according to a fourth embodiment of the present invention.
Figure 18:
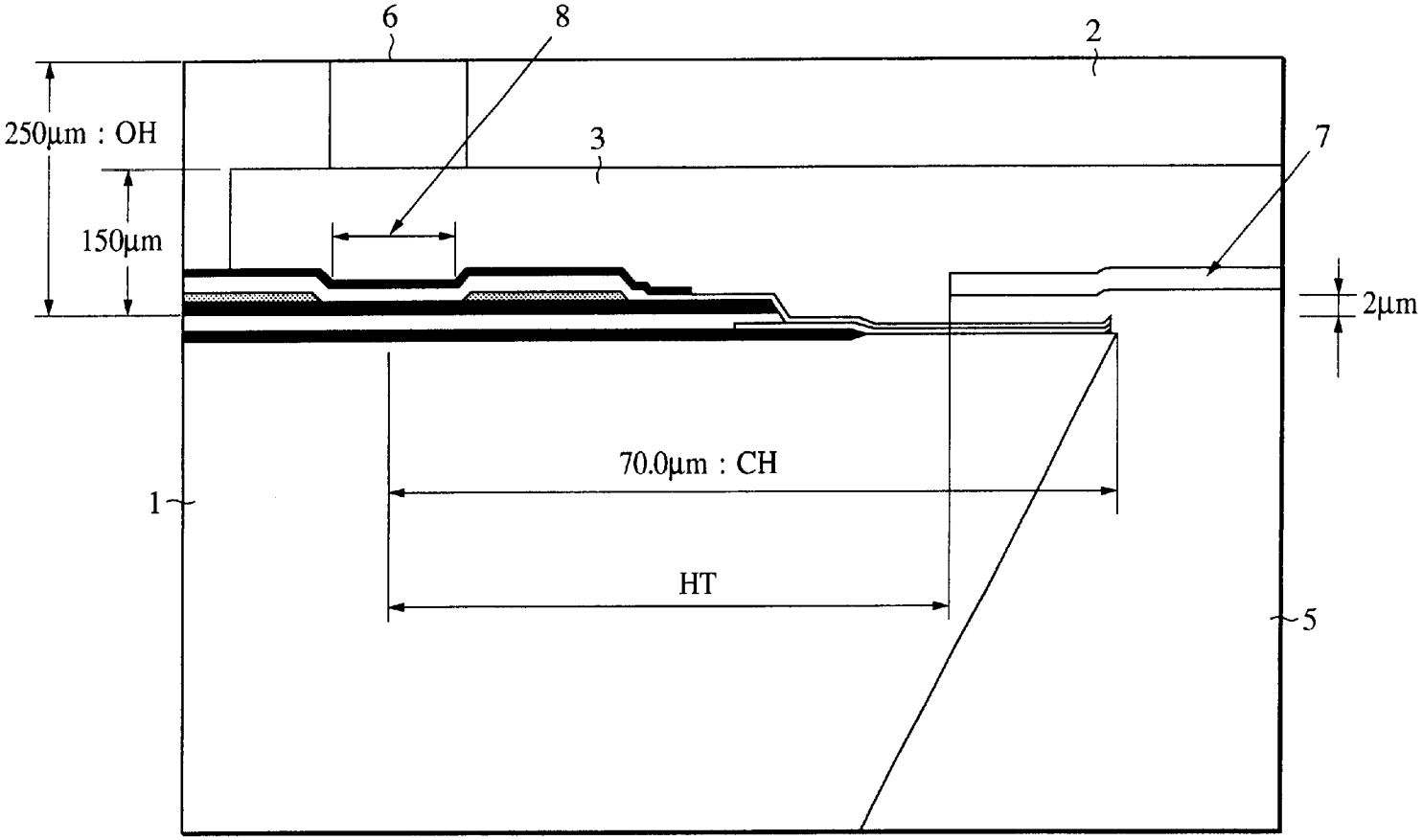
FIG. 18 is a cross-sectional view taken along the line A–A' in FIG. 17.
Figure 19:
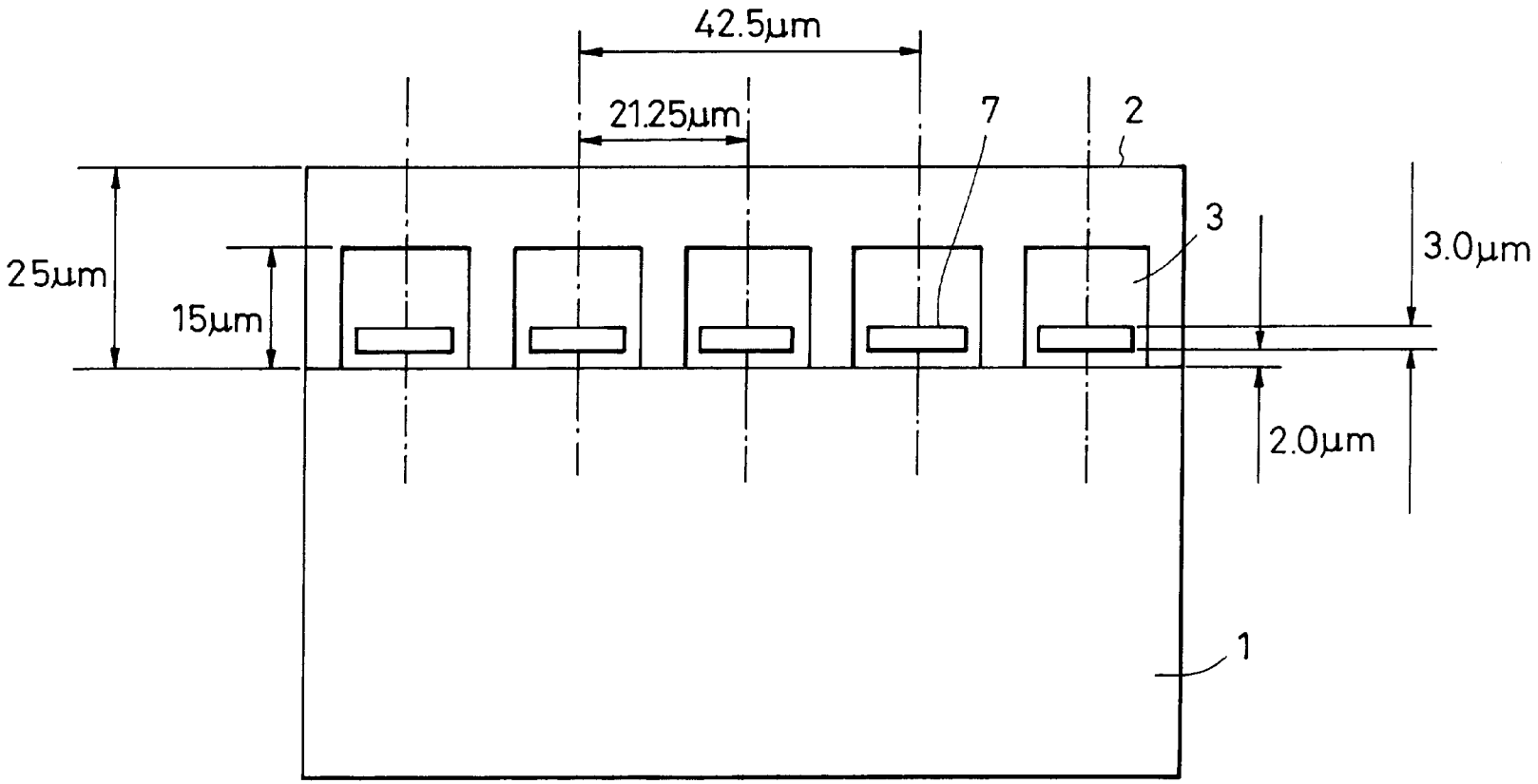
FIG. 19 is a cross-sectional view taken along the line B–B' in FIG. 17.

FIGS. 17 to 19 are views for illustrating a fourth embodiment of the present invention. FIG. 17 is a cross-sectional view of a liquid ejecting head of this embodiment in the direction of liquid ejection and corresponds to FIG. 3 of the first embodiment. FIGS. 18 and 19 are cross-sectional views taken along the line A–A' and the line B–B' in FIG. 17, and correspond to FIGS. 4 and 5, respectively. In this embodiment, as shown in FIG. 17, ends of a plurality of movable members 7 at the fulcrum side are bonded to each other, so that a U-shaped structure is formed. Due to the U-shaped structure described above, the effect of absorbing vertical vibration of the movable member 7 can be obtained.

In this embodiment, in a portion 7C of the movable member 7 which is fixed by the ejecting outlet forming member 2 in order to improve the adhesion of the movable member 7, a part of the portion 7C, which is at the liquid flow path 3 side, has a width larger than that of the other part of the portion 7C. In addition, end parts of the movable members 7, which are bonded together and have smaller widths, are each formed in an area other than that of the adjacent liquid flow path 3.

The other configuration of the liquid ejecting head according to this embodiment is equivalent to that of the liquid ejecting head of the first embodiment except for dimensions of the individual constituents.

In this embodiment, the dimensions of the constituents are as follows; the width of the liquid supply inlet is 64 $\mu$m, the gap between the liquid flow paths 3 is 21.25 $\mu$m, the distance CH from the center of the bubble generating region 8 to the liquid supply inlet 5 is 70 to 75 $\mu$m, the distance OH from the top surface of the bubble generating region 8 to the liquid ejecting outlet 6 is 25 $\mu$m, the height of the liquid flow path 3 is 15 $\mu$m, the width of the liquid flow path 3 is 16 $\mu$m (that is, the cross-sectional area Sh of the liquid flow path 3 is 240 $\mu m^2$), the opening area So of the ejecting outlet 6 is 400 to 500 $\mu m^2$, the distance HT from the center of the bubble generating region 8 to the free end 7B of the movable member 7 is 50 to 60 $\mu$m, the length of the movable member 7 is 100 $\mu$m, the width of the movable member 7 is 12 $\mu$m, the thickness of the movable member 7 is 3.0 $\mu$m, and the spacing between the bottom substrate of the movable member 7 and the surface of the substrate is 2.0 $\mu$m.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid ejecting head comprising:

a member provided with a plurality of ejecting outlets for ejecting liquid;

a substrate having a plurality of bubble generating means which generates thermal energy for generating and growing a bubble used for ejecting the liquid, the bubble generating means opposing the associated ejecting outlet;

a plurality of liquid flow paths each of which communicates with the associated ejecting outlet and has a bubble generating region for generating the bubble in the liquid by the thermal energy;

a liquid supply inlet which is a long through-hole formed in the substrate;

a common liquid supply chamber which communicates with the plurality of said liquid flow paths via the liquid supply inlet and which supplies liquid to the plurality of said liquid flow paths via the liquid supply inlet; and a plurality of movable members disposed in the longitudinal direction of the liquid supply inlet so as to cover the liquid supply inlet, each of the movable members having a free end in the associated liquid flow path and being supported above the liquid supply inlet with a minute spacing therebetween.

2. A liquid ejecting head according to claim 1, wherein the minute spacing between the movable member and the liquid supply inlet at the liquid flow path side is 5 $\mu$m or less.

3. A liquid ejecting head according to claim 1, wherein the bubble generating means has a portion for generating the thermal energy, and the surface of the substrate from the portion for generating the thermal energy to the liquid supply inlet is inclined downward.

4. A liquid ejecting head according to claim 1, wherein the bottom surface of the free end of the movable member in the initial state is not located above the top surface of the portion for generating the thermal energy of the bubble generating means.

5. A liquid ejecting head according to claim 4, wherein the top surface of the free end of the movable member in the initial state is located above the top surface of the portion for generating the thermal energy of the bubble generating means.

6. A liquid ejecting head according to claim 1, wherein the distance between the free end of the movable member and the end of the liquid supply inlet at the liquid flow path side is larger than the distance between the bottom surface of the movable member and the surface of the substrate.

7. A liquid ejecting head according to claim 1, further comprising an anticavitation film provided on the top surface of the portion for generating the thermal energy of the bubble generating means, wherein the movable member opposes an area of the substrate at the liquid supply inlet side at which the anticavitation film is not provided.

8. A liquid ejecting head according to claim 1, wherein the product of the surface area of the ejecting outlet and the distance between the top surface of the portion for generating the thermal energy of the bubble generating means and the ejecting outlet is larger than the product of the surface area of the liquid flow path and the distance between the center of the portion for generating the thermal energy of the bubble generating means and the free end of the movable member.

9. A liquid ejecting head according to claim 1, wherein the movable member comprises a movable portion and a bottom supporting portion which is covered by the member provided with the plurality of said ejecting outlets and which supports the bottom of the movable portion, and the bottom supporting portion has a width larger than that of the movable portion.

10. A liquid ejecting head according to claim 9, wherein the bottom supporting portion of the movable member is provided outside the liquid flow path.

11. A liquid ejecting head according to claim 1, wherein a plurality of said bottom supporting portions of the movable members is bonded to each other outside the liquid flow paths.

12. A liquid ejecting head according to claim 11, wherein the bonded portions of the plurality of said bottom supporting portions are end portions opposite to the free ends of the movable members.

13. A liquid ejecting head according to claim 1, wherein the movable member at the free end side is inclined downward from the fulcrum side of the movable member to the free end side.

14. A liquid ejecting head according to claim 1, wherein the liquid flow path comprises a ceiling portion located above the movable member and having a convex shape in the longitudinal direction of the movable member.

15. A liquid ejecting head according to claim 1, wherein the liquid flow path comprises a ceiling portion located above the movable member and having a step in the longitudinal direction of the movable member.

16. A liquid ejecting head according to claim 15, wherein a part of the ceiling portion located adjacent to the end portion of the movable member in the longitudinal direction thereof is lower than the other part of the ceiling portion, whereby the step of the ceiling portion is formed.

17. A liquid ejecting head according to claim 15, wherein a part of the ceiling portion located adjacent to the central portion of the movable member in the longitudinal direction thereof is lower than the other part of the ceiling portion, whereby the step of the ceiling portion is formed.

18. A method for ejecting liquid by using a liquid ejecting head which comprises a member provided with a plurality of ejecting outlets for ejecting liquid; a substrate having a plurality of bubble generating means which generates thermal energy for generating and growing a bubble used for ejecting the liquid, the bubble generating means opposing the associated ejecting outlet; a plurality of liquid flow paths each of which communicates with the associated ejecting outlet and has a bubble generating region for generating the bubble in the liquid by the thermal energy; a liquid supply inlet which is a long through-hole formed in the substrate; a common liquid supply chamber which communicates with the plurality of said liquid flow paths via the liquid supply inlet and which supplies liquid to the plurality of said liquid flow paths via the liquid supply inlet; and a plurality of movable members each disposed in the associated liquid flow path so as to cover the liquid supply inlet with a minute spacing therebetween, the movable member having a free end and a supporting portion, the free end being provided so as not to overlap the bubble generating region; the method comprising:

a step of substantially blocking the liquid supply inlet without contacting the bubble.

19. A liquid ejecting head comprising:

a member provided with a plurality of ejecting outlets which eject liquid;

a substrate having a plurality of energy generating means which generates energy for ejecting the liquid, the energy generating means opposing the associated ejecting outlet;

a plurality of liquid flow paths formed between the member provided with the plurality of said ejecting outlets and the substrate;

a liquid supply inlet which is a long through-hole formed in the substrate;

a common liquid supply chamber which communicates with the plurality of said liquid flow paths via the liquid supply inlet and which supplies liquid to the plurality of said liquid flow paths via the liquid supply inlet; and a plurality of movable members disposed in the longitudinal direction of the liquid supply inlet so as to cover the liquid supply inlet, each of the movable members having a free end in the associated liquid flow path and being supported above the liquid supply inlet with a minute spacing therebetween.

20. A liquid ejecting head according to claim 19, wherein liquid flow paths containing movable members which are disposed at both ends of the plurality of said movable members are dummy liquid flow paths.

* * * * *